US008776813B2

(12) United States Patent
DeLap et al.

(10) Patent No.: US 8,776,813 B2
(45) Date of Patent: Jul. 15, 2014

(54) TENT POLE CONNECTION SYSTEM AND METHODS

(75) Inventors: Christopher K. DeLap, Cottonwood Heights, UT (US); Christopher T. Pietrzak, Park City, UT (US); Ross M. Hinschberger, West Valley City, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 66 days.

(21) Appl. No.: 12/815,153

(22) Filed: Jun. 14, 2010

(65) Prior Publication Data

US 2011/0303255 A1 Dec. 15, 2011

(51) Int. Cl.
*E04H 15/60* (2006.01)

(52) U.S. Cl.
CPC ..... *E04H 15/60* (2013.01)
USPC ..... 135/114

(58) Field of Classification Search
USPC ..... 135/114; 403/286, 300, 303, 305, 308, 403/109.1–109.8, 220, 221, 291–298
See application file for complete search history.

(56) References Cited

U.S. PATENT DOCUMENTS 1,817,775 A * 8/1931 Sipe ..... 403/361
2,311,355 A * 2/1943 Thornquist ..... 135/114
2,379,577 A * 7/1945 Harsted ..... 52/110
3,053,559 A * 9/1962 Frick ..... 403/9
3,070,107 A * 12/1962 Beatty ..... 135/87
3,223,098 A * 12/1965 Dole, Jr. ..... 135/126
3,448,748 A * 6/1969 Walrave ..... 135/127
3,834,410 A 9/1974 Leibel
3,886,700 A * 6/1975 Lambert ..... 52/108
3,941,140 A 3/1976 Beavers
3,957,069 A 5/1976 Denaro
3,970,096 A 7/1976 Nicolai
4,063,830 A * 12/1977 Ban ..... 403/3
4,078,572 A 3/1978 Moss
4,132,408 A * 1/1979 Sabat ..... 463/47.5
4,160,607 A * 7/1979 Reichow ..... 403/286
4,165,757 A 8/1979 Marks
4,236,543 A 12/1980 Moss
4,265,259 A 5/1981 Gillis
4,265,260 A 5/1981 Gillis
4,265,261 A 5/1981 Barker
4,285,355 A 8/1981 Lundblade
4,352,362 A 10/1982 Nichols
4,369,000 A 1/1983 Egnew
4,414,993 A 11/1983 Gillis
4,590,956 A 5/1986 Griesenbeck
4,632,138 A 12/1986 Irwin
4,703,769 A 11/1987 Harrison (Continued)

FOREIGN PATENT DOCUMENTS

CA 2149623 A1 11/1996
CN 2806665Y Y 8/2006

(Continued)

*Primary Examiner* — Noah Chandler Hawk
(74) *Attorney, Agent, or Firm* — Holland & Hart

(57) ABSTRACT

A tent pole assembly that includes first and second pole sections, first and second inserts, and a projection member. Each of the pole sections includes an open end. The first and second inserts are positionable into the open ends of the first and second pole sections, respectively. The projection member is insertable into the first and second inserts to releasably connect the first and second pole sections together.

13 Claims, 21 Drawing Sheets

(56) References Cited

U.S. PATENT DOCUMENTS

| | | | | |
|---|---|---|---|---|
| 4,706,696 | A | 11/1987 | Gillis | |
| 4,750,509 | A | 6/1988 | Kim | |
| 4,838,293 | A | 6/1989 | Novak | |
| 4,852,598 | A | 8/1989 | Griesenbeck | |
| 4,944,322 | A | 7/1990 | Gillis | |
| 4,979,531 | A | 12/1990 | Toor | |
| 4,981,387 | A | 1/1991 | Younjae | |
| 5,067,505 | A | 11/1991 | Cantwell | |
| 5,069,572 | A | 12/1991 | Niksic | |
| 5,090,837 | A | 2/1992 | Mower | |
| 5,127,762 | A * | 7/1992 | Havlovitz | 403/298 |
| 5,197,504 | A | 3/1993 | Howe | |
| 5,201,598 | A | 4/1993 | Tehan | |
| 5,255,698 | A | 10/1993 | Riley | |
| 5,407,291 | A | 4/1995 | Hazinski | |
| 5,590,674 | A | 1/1997 | Eppenbach | |
| 5,593,239 | A * | 1/1997 | Sallee | 403/109.3 |
| 5,628,336 | A | 5/1997 | Lee | |
| 5,662,134 | A | 9/1997 | Auer | |
| 5,683,199 | A | 11/1997 | Tehan | |
| 5,732,726 | A | 3/1998 | Lee | |
| 5,771,912 | A | 6/1998 | Swetish | |
| 5,927,311 | A | 7/1999 | Jager | |
| 6,000,175 | A | 12/1999 | Gale | |
| 6,042,297 | A | 3/2000 | Lah | |
| 6,200,060 | B1 | 3/2001 | Vernay | |
| 6,286,531 | B1 | 9/2001 | Joo Tai | |
| 6,382,223 | B1 | 5/2002 | Lah | |
| 6,557,572 | B2 | 5/2003 | Lah | |
| 6,678,989 | B1 * | 1/2004 | Lowe | 43/6 |
| 6,679,643 | B1 | 1/2004 | Ham | |
| 6,679,644 | B1 | 1/2004 | Heller | |
| 6,748,962 | B2 | 6/2004 | Miller | |
| 6,811,347 | B1 * | 11/2004 | Hsieh | 403/300 |
| 6,854,476 | B1 | 2/2005 | Chai | |
| 7,025,073 | B2 | 4/2006 | Holub | |
| 7,063,481 | B2 | 6/2006 | Trull | |
| 7,128,078 | B2 | 10/2006 | Chang | |
| 7,185,666 | B2 | 3/2007 | Chai | |
| 7,607,445 | B2 | 10/2009 | von Dewitz | |
| 7,628,165 | B2 | 12/2009 | Rothweil | |
| 2002/0020439 | A1 | 2/2002 | Tate | |
| 2002/0066239 | A1 | 6/2002 | Gillis | |
| 2002/0117196 | A1 | 8/2002 | Han | |
| 2002/0153033 | A1 | 10/2002 | Miller | |
| 2002/0179133 | A1 | 12/2002 | Abbinante | |
| 2003/0000563 | A1 | 1/2003 | Kuperman | |
| 2003/0089390 | A1 | 5/2003 | Seo | |
| 2004/0050413 | A1 | 3/2004 | Cooper | |
| 2005/0074278 | A1 * | 4/2005 | Tani | 403/300 |
| 2005/0092355 | A1 | 5/2005 | Hsu | |
| 2005/0126617 | A1 | 6/2005 | Holub | |
| 2006/0016467 | A1 | 1/2006 | Bae | |
| 2006/0090785 | A1 | 5/2006 | Ju | |
| 2006/0162757 | A1 | 7/2006 | Kim | |
| 2006/0169729 | A1 | 8/2006 | Reis | |
| 2006/0233599 | A1 | 10/2006 | Lah | |
| 2006/0289705 | A1 | 12/2006 | Han | |
| 2007/0012346 | A1 | 1/2007 | Choi | |
| 2007/0017564 | A1 | 1/2007 | Lah | |
| 2007/0240747 | A1 | 10/2007 | Scherer | |
| 2008/0006317 | A1 | 1/2008 | Livacich | |
| 2008/0142063 | A1 | 6/2008 | Lah | |
| 2008/0271769 | A1 | 11/2008 | Lah | |
| 2009/0020146 | A1 | 1/2009 | Bong | |
| 2009/0056782 | A1 | 3/2009 | Jones | |
| 2009/0062026 | A1 | 3/2009 | Cho | |
| 2009/0114260 | A1 | 5/2009 | Knipschild | |
| 2009/0173369 | A1 | 7/2009 | Lah | |
| 2009/0188538 | A1 | 7/2009 | Kim | |
| 2009/0242009 | A1 | 10/2009 | Adams | |
| 2009/0260664 | A1 | 10/2009 | Ma | |
| 2009/0314322 | A1 | 12/2009 | Choi | |
| 2009/0320893 | A1 | 12/2009 | Engstrom | |

FOREIGN PATENT DOCUMENTS

| | | | |
|---|---|---|---|
| CN | 200992834 | Y | 12/2007 |
| DE | 3114516 | A1 | 1/1982 |
| DE | 3330860 | A1 | 3/1985 |
| DE | 3820725 | A1 | 12/1989 |
| DE | 4134649 | A1 | 4/1993 |
| DE | 19737368 | A1 | 2/1999 |
| DE | 10028307 | C1 | 10/2001 |
| DE | 202006007892 | U1 | 9/2006 |
| DE | 102005020291 | A1 | 1/2007 |
| DE | 102007020972 | A1 | 11/2008 |
| EP | 683292 | A1 | 11/1995 |
| EP | 1310616 | A2 | 5/2003 |
| FR | 2705385 | A3 | 11/1994 |
| GB | 1062963 | A | 3/1967 |
| GB | 2148967 | A | 6/1985 |
| GB | 2249331 | A | 5/1992 |
| GB | 2369130 | A | 5/2002 |
| GB | 2423096 | A | 8/2006 |
| JP | 11141193 | A | 5/1999 |
| JP | 2000017895 | A | 1/2000 |
| KR | 820000783 | Y1 | 4/1982 |
| KR | 970002486 | Y1 | 3/1997 |
| KR | 20030006480 | A | 1/2003 |
| KR | 20090059459 | A | 6/2009 |

* cited by examiner

TENT POLE CONNECTION SYSTEM AND METHODS

TECHNICAL FIELD

The present disclosure relates generally to tent support systems, and more particularly to modular tent pole assemblies, tent pole connection systems and related methods.

BACKGROUND

A tent typically comprises a frame and a flexible sheet of material supported by the frame to provide at least a partial enclosure. The frame typically includes a plurality of tent pole sections. Traditionally, each tent pole is modular (i.e., it comprises multiple pole sections that can be separated for transport and storage). To erect the tent, the modular tent pole sections are coupled together in end-to-end relationships. To take down the tent, the tent pole sections are disconnected and gathered in their shorter sections for transport and storage.

In one traditional tent pole fastening system, each of the pole sections includes an elongated member, or rod, and a ferrule attached at one end of the elongated member. The ferrule provides a cavity that receives and may frictionally retain an end portion of an adjacent pole section. This fastening system is not completely satisfactory because, for example, the frictional force between the ferrule and the adjacent pole section may be too tight, thereby making the assembly and disassembly of the pole sections difficult. Alternatively, the frictional fit may be too loose, in which event the pole sections may separate during erection of the tent. Furthermore, when disassembled, such pole sections are not interconnected and are easily lost.

To address these problems, use of an elastic cord to fasten and retain pole sections together has become common. Elastic cord systems employ pole sections, each of which has an axial passage running completely through the pole section. An elongated, resilient cord (e.g., an elastic cord) extends through the passages of each of the pole sections of each tent pole assembly to resiliently retain the pole sections together. With this construction, when one end portion of a pole section is telescopically received in the cavity formed by the ferrule of the adjacent pole section, tension in the resilient member draws adjacent pole sections together. The resilient member is sufficiently flexible so that when the adjacent pole sections are separated, the resilient member may be folded to allow the adjacent pole sections to be oriented in side-by-side relationship. An elastic cord fastening system may function well in use, but may present difficulties when either the pole sections or the fastening system must be repaired. The elastic cord must be cut, or disconnected, the repair completed, and then the elastic cord must be reconnected to the pole system. Often, such repairs require special tools and experience to be done effectively. Typically, such repairs often cannot be done by the tent owner, or even by average retail store personnel. Consequently, the tent owner sometimes must purchase an entire new pole because repair of the damaged pole may not be done cost effectively.

Another disadvantage of elastic cord tensioning systems relates to the amount of material and associated weight of the entire system. In many tent applications (e.g., backpacking and mountaineering), any reduction in weight without sacrificing function or quality is a benefit.

SUMMARY

One aspect of the present disclosure relates to a tent pole assembly that includes first and second pole sections, first and second inserts, and a projection member. Each pole member may define an open end. The first and second inserts are insertable into the open ends of the first and second pole sections, respectively. The projection member is insertable into the first and second inserts to releasably connect the first and second pole sections together.

The tent pole assembly may further include a connection member that is arranged to couple the first and second inserts as well as the projection member together in an assembly. At least a portion of the first and second inserts may be configured to be positioned outside of the first and second pole sections, respectively. At least one of the first and second inserts may include a first connection feature that mates with a second connection feature of the projection member to create a releasable connection. The first and second inserts may be constructed to provide an interference fit within the first and second pole sections, respectively.

The tent pole assembly may further comprise first and second end abutment plates positioned at opposing first and second ends portions of the connection member, wherein the first and second end abutment plates are arranged and configured to maintain the first and second inserts on the connection member. The first connection feature may include resilient arm members, and the second connection feature may include a groove, wherein the resilient arm is movable into and out of the groove.

The first and second inserts may each include a first connection feature, and the projection member may include a second connection feature positioned at opposing ends of the projection member. The first and second connection features mate to provide a releasable connection between the first and second inserts and the projection member. The first connection feature may include a resilient arm, and the second connection feature may include a groove that receives a portion of the resilient arm. At least one of the first insert, second insert, and projection member may comprise a metal material, a plastic material, a composite material, such as a layer of composite material, or any other suitable material.

Another aspect of the present disclosure relates to a tent pole connection system that includes a hollow first insert, a hollow second insert, a hollow projection member, and a connection member. The first insert has a first end configured to be inserted into a first tent pole section. The second insert has a first end configured to be inserted into a second tent pole section. The projection member has a first end insertable into the first insert, and a second end insertable into the second insert. The connection member extends through the first and second inserts and the projection member to maintain the projection member and the first and second inserts together as an assembly.

At least one of the first and second inserts may include a first connection feature at the first end of the first insert, and the projection member may include a second connection feature at the first end of the projection member. The first and second connection features may provide a releasable connection there between. The tent pole connection system may further include at least one stop feature, such as an abutment plate, positioned at opposing first and second end portions of the connection member. The first and second end abutment plates may retain the first and second inserts on the connection member.

A further aspect of the present disclosure relates to a method of assembling a tent pole assembly. The method may include providing first and second tent pole sections and a tent pole connection system, wherein the tent pole connection system includes first and second inserts at least partially inserted into the first and second tent pole sections, respectively, and a projection member having first and second ends. The method may further include inserting the first end of the projection member into the first insert, inserting the second end of the projection member into the second insert and providing a releasable connection between the projection member and at least one of the first and second inserts.

The first and second inserts and the projection member may be hollow, and the method may further comprise providing a connection member extending through the first and second inserts and the projection member, wherein the connection member couples the first and second inserts and the projection member together as an assembly. The at least one of the first and second inserts may include a first connection feature, and the projection member may include a second connection feature, and providing a releasable connection may include mating the first and second connection features. The first and second inserts may each include a first end configured to be inserted into the first and second tent pole sections, respectively, and a second end configured to remain positioned outside of the first and second tent pole sections, respectively. The method may further include inserting the projection member into the first and second inserts until the second ends of the first and second inserts contact each other.

A further method in accordance with the present disclosure includes providing first and second tent pole sections, first and second inserts, a projection member, and a connection member, inserting the first and second inserts into the first and second tent pole sections, respectively, inserting a first end of the projection member into the first insert and inserting a second end of the projection member into the second insert to provide a releasable connection between the first and second tent pole sections, removing the projection member from at least one of the first and second inserts to disconnect the first and second tent pole sections, wherein the connection member maintains assembly of the first and second inserts and the projection member.

At least one of the first and second inserts may include a first connection feature, and the insert may include a second connection feature, and inserting the projection member into the first and second inserts creates a releasable connection between the first and second connection features. The method may further comprise removing the projection member from each of the first and second inserts to disconnect the first and second tent pole sections. Inserting the projection member into the first and second inserts may arrange the first and second tent pole sections coaxial with each other. The method may further include arranging the first and second tent pole sections in a parallel, side-by-side arrangement after removing the projection member from at least one of the first and second inserts.

Another aspect relates to a tent pole assembly that includes first and second tent pole sections, and a tent pole union completely separable from the first tent pole section and the second tent pole section during operation of the tent pole assembly. The tent pole union may include first and second inserts configured to insert into and connect to the first and second tent pole sections, respectively, with an interference fit. The tent pole union may further comprise a projection member configured to insert into and connect to the first and second inserts.

A further aspect relates to a tent pole connection system that includes a compression fitting union comprising a plurality of connection parts separate from a pair of tent pole sections. The connection parts provide a releasable connection between the pair of tent pole sections, wherein on at least one end of the compression fitting union a two-part construction is provided including a first part that is movable relative to a second part between locked and released positions. The first and second parts may be connected with a snap-fit connection when in the locked position. The tent pole connection system may further include a connection member operable to maintain assembly of the tent pole connection system together when the connection parts are disconnected from each other.

Another aspect relates to a tent pole assembly that includes first and second tent pole sections and a connection assembly. The connection assembly is configured to releasably connect the first and second tent pole sections together. The connection assembly extends along only a partial length of each of the first and second tent pole sections. The connection assembly may be coupled together with a fixed length connection member.

The connection assembly may include first and second inserts insertable into the first and second tent pole sections, respectively, to connect the connection assembly to the first and second tent pole sections. The first and second inserts may be removable from the first and second tent pole sections to completely disconnect the connection assembly from the first and second tent pole sections during operation of the tent pole assembly. The fixed length connection member may extend through a plurality of parts of the connection assembly.

Another aspect of the present disclosure relates to a tent pole assembly that includes first and second tent pole sections and a multi-piece tent pole connection system. The first and second tent pole sections are arranged end-to-end and non-overlapping. Each tent pole section has an outer profile. The multi-piece tent pole connection system is separately mountable to the first and second tent pole sections and configured to releasably connect together only the first and second tent pole sections. The tent pole connection system is maintained entirely within the outer profiles of the tent pole sections and entirely with a compact longitudinal connection location when the first and second tent pole sections are connected together.

The multi-piece tent pole connection system may also include a first insert insertable into the first tent pole section, a second insert insertable into the second tent pole section, and a projection member insertable into the first and second inserts. The projection member may have a releasable connection with at least one of the first and second inserts. The tent pole connection system may be coupled together as an assembly with a connection member prior to mounting to the first and second tent pole sections.

A further aspect of the present disclosure relates to a method of releasably connecting first and second tent pole sections. The method includes providing a tent pole connection system including first and second inserts and a projection member, coupling the tent pole connection system together as an assembly with the projection member coupled to the first and second inserts, mounting the first and second inserts to the first and second tent pole sections, respectively, and connecting the projection member to the first and second inserts to releasably connect the first and second tent pole sections.

The tent pole connection system may further include a connection member, and assembling the tent pole connection system together as an assembly may include extending the connection member through the projection member and coupling the connection member to the first and second inserts. Connecting the projection member to the first and second inserts may include providing an interference fit between the projection member and at least one of the first and second inserts. Connecting the projection member to the first and second inserts may include providing a key hole locking arrangement between the projection member and at least one of the first and second inserts. Connecting the projection member to the first and second inserts may include inserting at least a portion of the projection member over a portion of at least one of the first and second inserts.

Mounting the first and second inserts to the first and second tent pole sections, respectively, may include inserting a portion of the first and second inserts into the first and second tent pole sections and extending a portion of the first and second inserts over an outer surface of the first and second tent pole sections. Connecting the projection member to the first and second inserts includes providing the connection member with at least one resilient arm that provides a snap-fit connection with at least one of the first and second inserts. The projection member may project at least partially into each of the first and second inserts when the first and second tent pole sections are assembled together.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
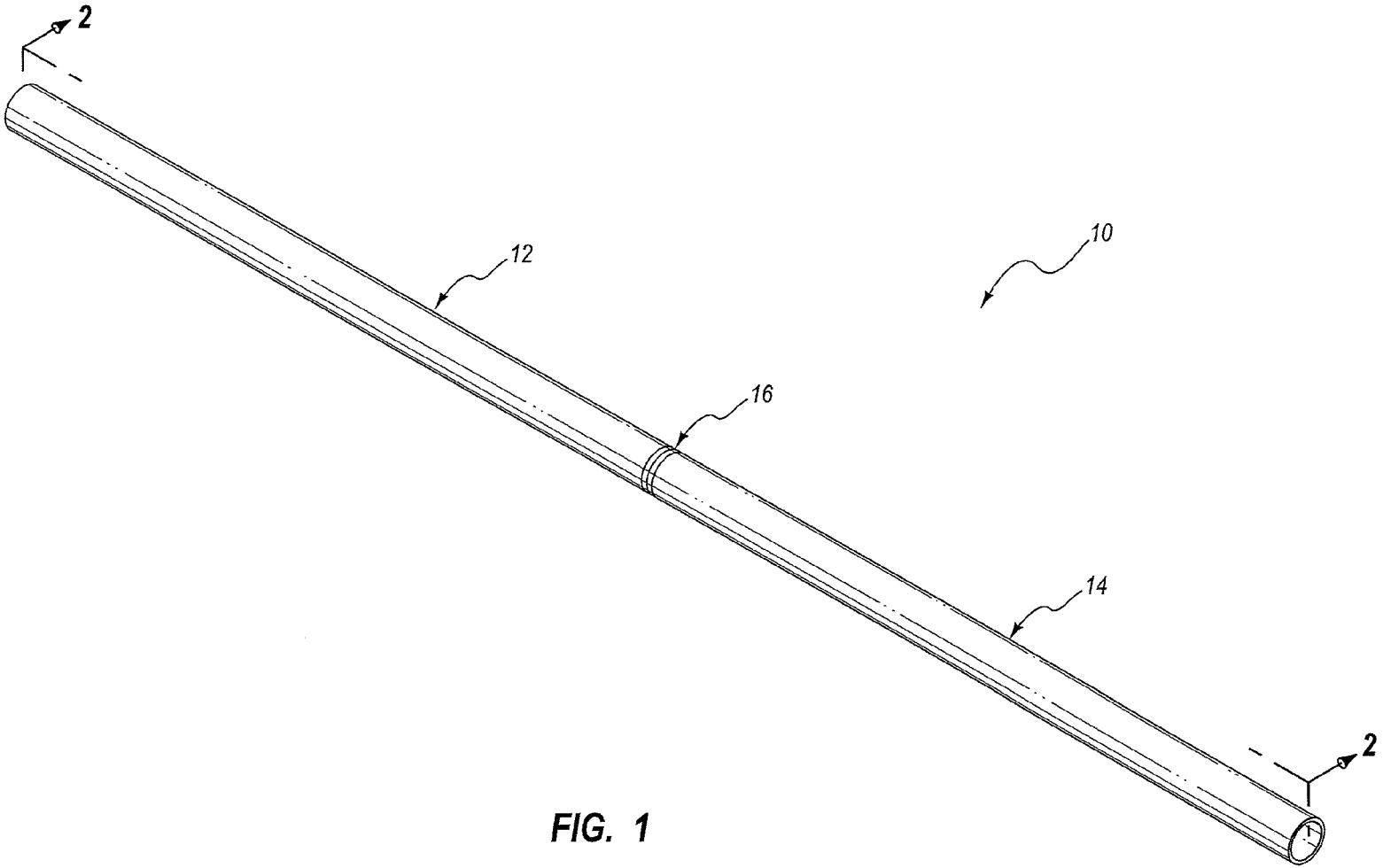
FIG. 1 is a perspective view of an example tent pole assembly with two pole segments fully assembled in accordance with the present disclosure.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of skill in the art will understand that the exemplary embodiments described herein are not intended to be limited to the particular forms disclosed. Rather, the instant disclosure covers all modifications, equivalents, and alternatives falling within the scope defined by the appended claims.

DETAILED DESCRIPTION

The present application is directed to tent support systems, including tent pole assemblies used to support tents. Further, the present application is directed to tent pole connection systems that are used to connect sections or segments of a tent pole together in the tent pole assembly. The tent pole connection systems disclosed herein may be used in place of traditional connection systems for tent pole sections, such as the elastic cord retention system described above. The example tent pole connection systems disclosed herein may provide improved ease in repairing a tent pole, such as replacing tent pole sections, or repair of damaged portions of the tent pole connection system or replacement of the entire tent pole connection system. The tent pole connection system may, in some applications, easily be removed and/or replaced in the field. In other applications, the tent pole connection system may be fixed to one or more of the tent poles using adhesive or a bonding agent or method. The example tent pole connection systems may provide a reduced total weight as compared to other types of tent pole connection systems, such as the elastic cord retention system described above.

In at least one example, an example tent pole connection system may be used to retain first and second pole sections together as an assembly both when the pole sections are arranged in a side-by-side, disconnected manner, and when the pole sections are arranged coaxially and connected together to form an assembled tent pole.

An example tent pole assembly may include first and second pole sections, first and second projection members that are inserted into open ends of the first and second pole sections, and a projection member with opposed projections that are insertable into each of the first and second inserts to connect the first and second pole sections. The tent pole assembly may additionally include a linkage comprising a connection member that maintains together, whether assembled or disconnected to the tent pole sections, the inserts and the projection member. The linkage assembly may also include first and second end abutment plates against which inserts may abut during assembly and disassembly. The linkage assembly may further include any type of crimping or locking device to provide connection between the inserts and projection member, or between the tent pole assembly and tent poles.

At least one of the first and second inserts may be releasably connected to the projection member to facilitate temporary connection and disconnection of the first and second pole sections relative to each other. In some arrangements, at least one insert and the projection member interface to provide a releasable snap-fit connection.

End abutment plates may be used to help remove the inserts from the pole sections. Such a disassembly may be useful when repairing or replacing portions of the tent pole connection system or the tent pole sections. Typically, the inserts are maintained in their installed position within the pole sections until purposefully removed by a user.

Figure 3:
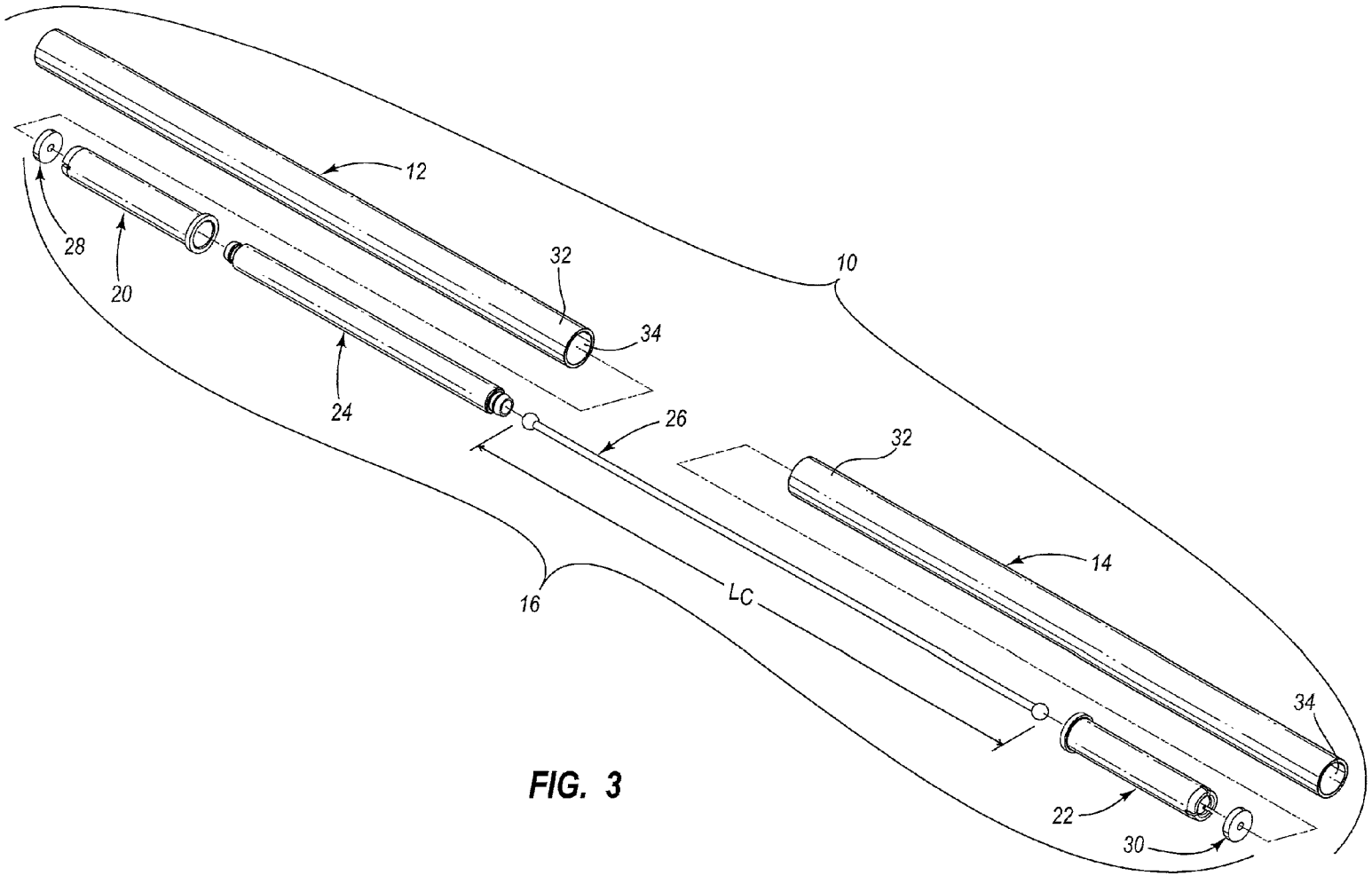
FIG. 3 is an exploded perspective view of the tent pole assembly of FIG. 1.
Figure 4:
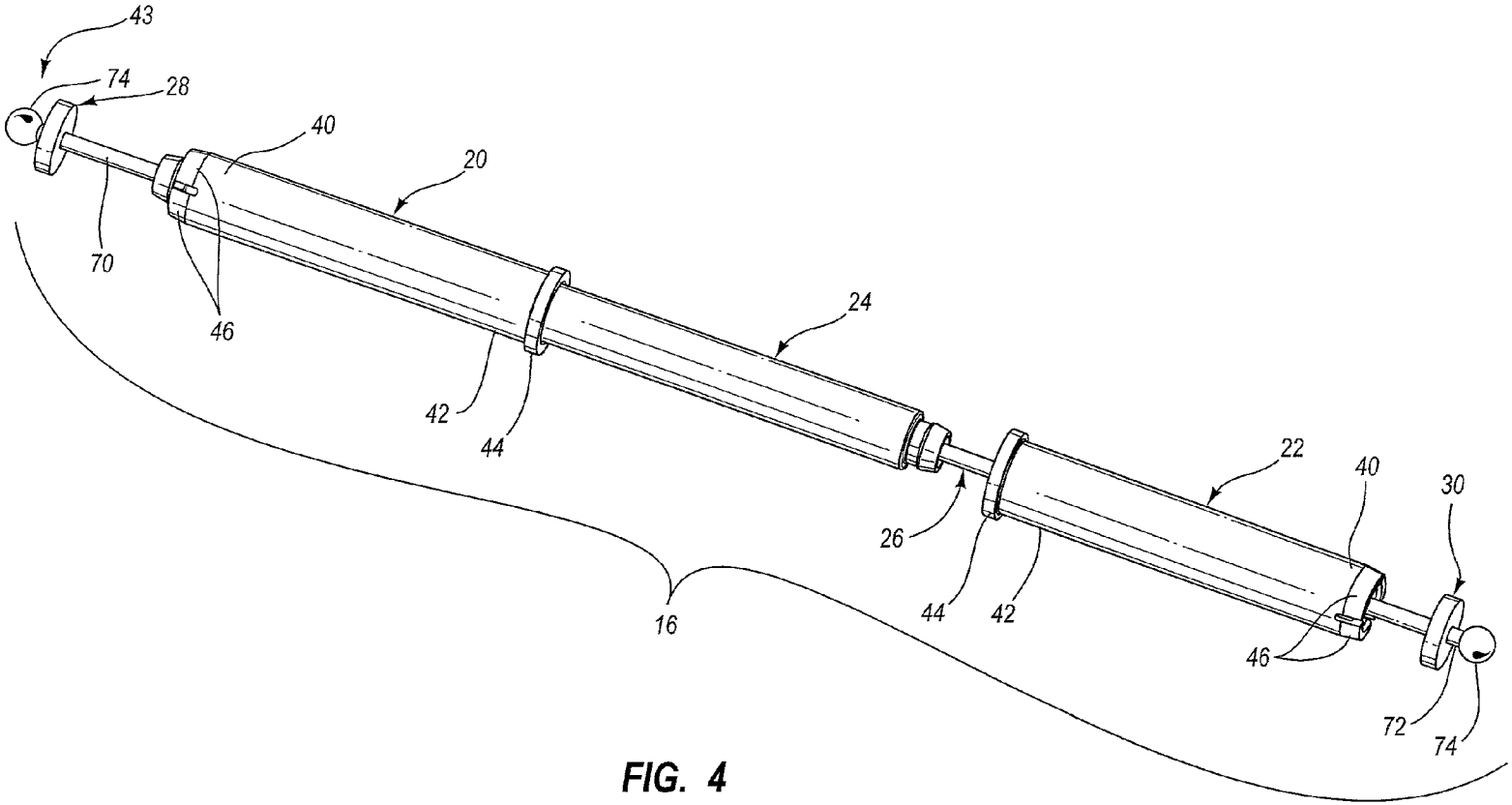
FIG. 4 is a perspective view of a tent pole connection system of the tent pole assembly of FIG. 1.
Figure 5:
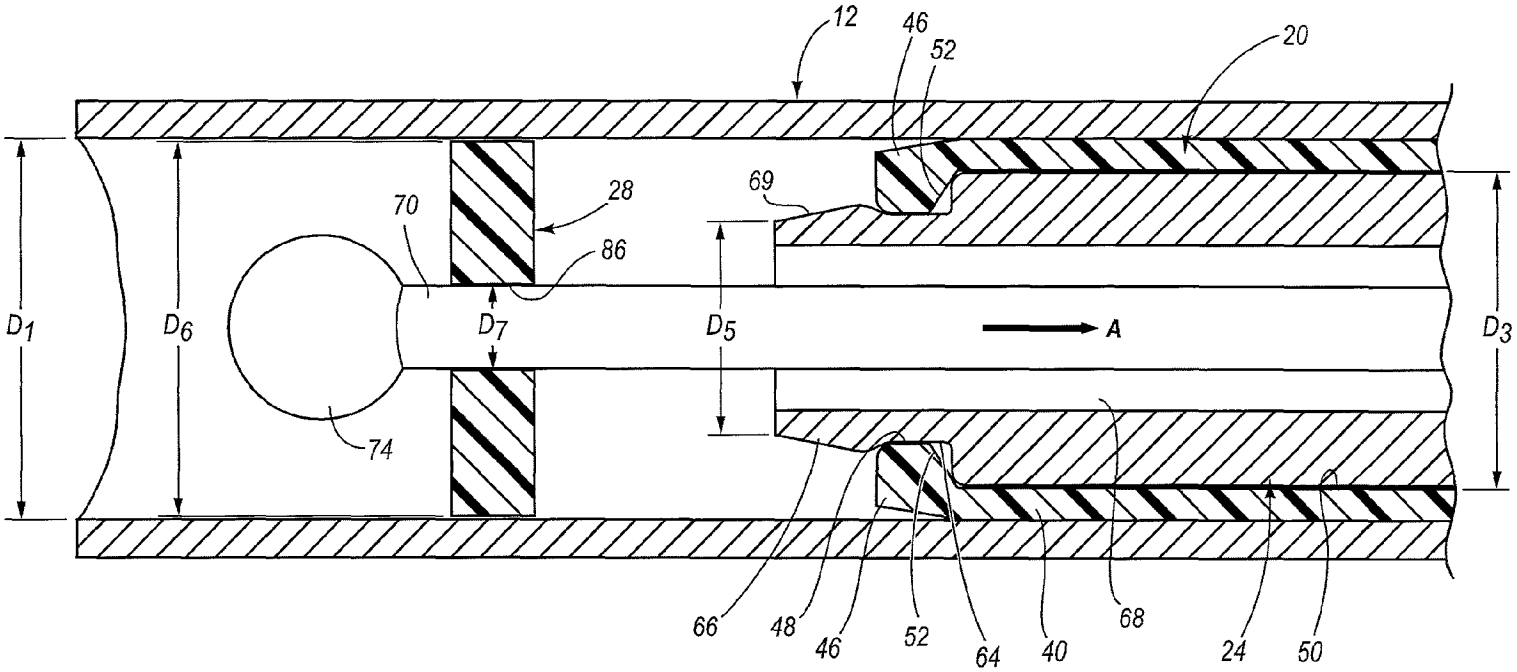
FIG. 5 is a cross-sectional view of a portion of the tent pole assembly of FIG. 1.

Referring now to FIGS. 1-11, an example tent pole assembly 10 is shown and described. The tent pole assembly 10 includes first and second tent pole sections 12, 14, and a tent pole connection system 16. The first and second tent pole sections 12, 14 each includes an end 32 and a cavity 34 (see FIG. 3). The first and second tent pole sections 12, 14 have lengths $L_{P1}$, $L_{P2}$, respectively (see FIG. 3). The lengths $L_{P1}$, $L_{P2}$ of the first and second tent pole sections 12, 14 may define an entire length of the tent pole. Typically, the first and second tent pole sections 12, 14 make up only a portion of a tent pole, and the lengths $L_{P1}$, $L_{P2}$ represent only a portion of length of the tent pole. As shown in FIG. 5, the tent pole sections each has an inner dimension $D_1$ (i.e., a diameter) sized to permit insertion of at least a portion of the tent pole connection system 16 for use in connecting the first and second tent pole sections 12, 14 together.

The tent pole connection system 16 includes first and second inserts 20, 22, a projection member 24, and a linkage assembly comprising a connection member 26 and first and second end abutment or stop members 28, 30. The tent pole connection system 16 may also be referred to as a compression union or a snap-locking connection assembly. The tent pole connection system 16 may include a plurality of connection parts or members that are movable, slidable, or actuatable relative to each other or to the first and second tent pole sections 12, 14 to provide alternate locked and released positions during assembly and disassembly of the tent pole sections. The arrangement of one of the first and second inserts 20, 22 with the projection member 24 at one end of the tent pole connection system 16 may be defined as a two-part construction that provides a snap-fit, interference fit, or compression fit connection system used to lock and alternately release the first and second tent pole sections 12, 14 relative to each other.

The tent pole connection system 16 may be completely separable in function and in operation from the first and second tent pole sections 12, 14. The tent pole connection system 16 may be removable from the first and second tent pole sections 12, 14 without causing damage to the tent pole assembly and without causing damage to the first and second tent pole sections 12, 14. The tent pole connection system 16 may be removable from the first and second tent pole sections 12, 14 in a way that permits immediate, in-the-field connection and disconnection of the tent pole connection system 16 to the first and second tent pole sections 12, 14. Alternatively, at least some portions of the tent pole connection system 16 may be permanently connected to one or both of the first and second tent pole sections 12, 14 using, for example, an adhesive or other bonding method. In at least one embodiment, one or more of the first and second inserts 20, 22 is bonded to its respective first or second tent pole section 12, 14.

With reference to FIG. 4 the first and second inserts 20, 22 include first and second ends 40, 42, respectively, a shoulder 44 at the second end 42, a plurality of flexible compression projections 46 positioned at the first end 40, an opening 48 (see FIG. 5), and an interior cavity 50. The compression projections 46 flex when the projection member 24 is inserted or positioned inside one of the first or second inserts 20, 22 to securely hold the inserts first and second inserts 20, 22, along with the projection member 24, inside the first and second tent pole sections 12, 14. The compression projections 46 may be references have some flexibility or resiliency, and may be referenced as flexible or resilient arms.

The first end 40 has an outer dimension $D_2$ (see FIG. 6) sized to allow the first insert 20 to be positioned inside the cavity 34 of one of the first and second tent pole sections 12, 14. As shown in FIG. 5, the cavity 50 of the first insert 20 has an inner dimension $D_3$ sized to receive a portion of the projection member 24. The first end 40 may be sized to provide an interference fit with an inner surface of the first and second tent pole sections 12, 14 to help retain the first and second inserts 20, 22 within the first and second tent pole sections 12, 14. In at least one arrangement, the dimensions $D_1$, $D_2$ are similar and matched to each other for an appropriate fit.

Figure 2:
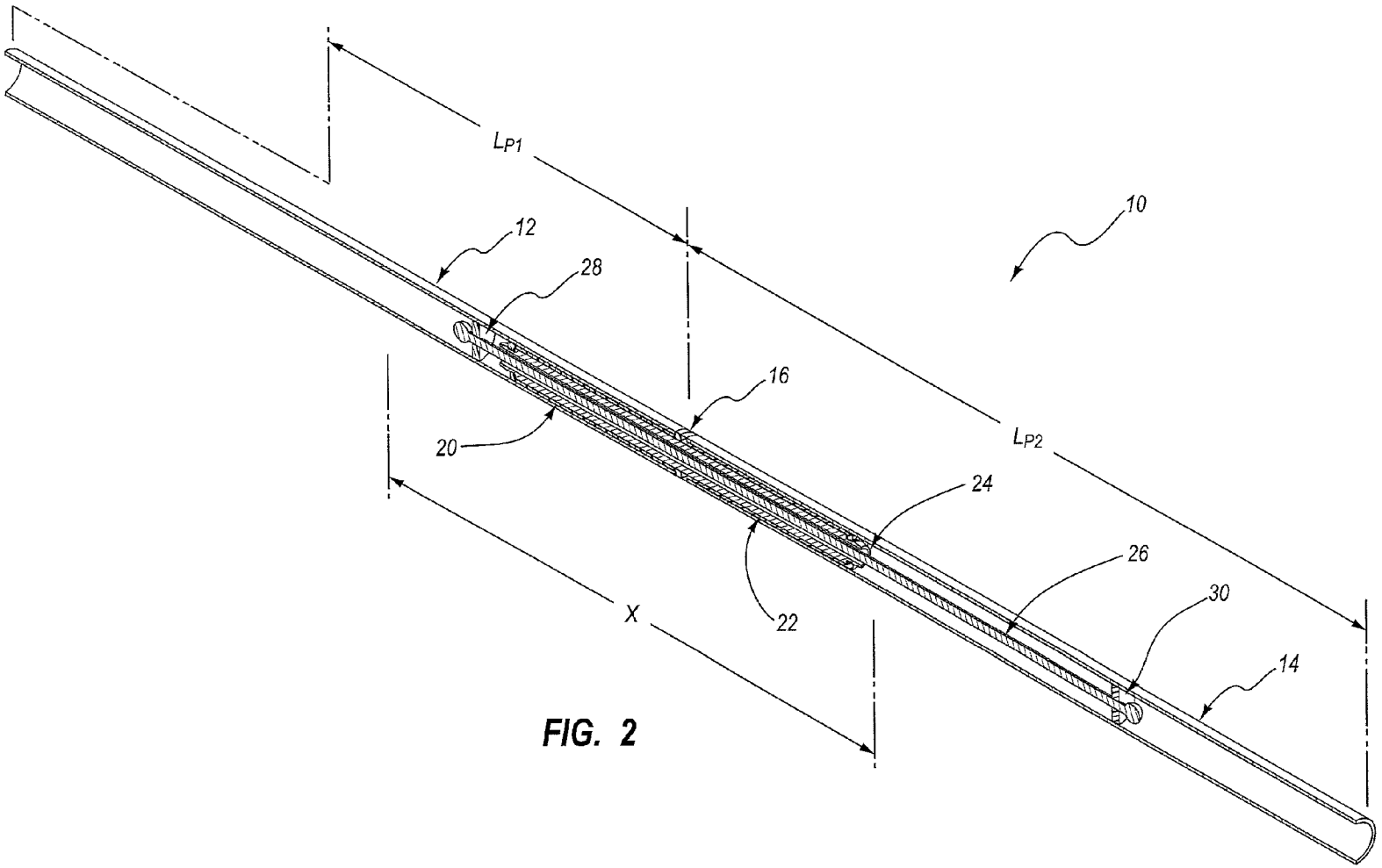
FIG. 2 is a cross-sectional perspective view of the tent pole assembly of FIG. 1 taken along cross-section indicators 2-2.

Typically, a portion of the first and second inserts 20, 22 is sized greater than the inner dimension $D_1$ of the first and second tent pole sections 12, 14, and thus remains outside of these tent pole sections. As shown in FIG. 4, a shoulder 44 is provided, which may be greater in diameter than the outer dimension $D_2$ and the inner dimension $D_1$. Shoulder 44 defines a surface against which an end of the first and second tent pole sections 12, 14 abut. The respective shoulders 44 of the first and second inserts 20, 22 may be arranged adjacent to and in contact with each other when the tent pole assembly 10 is assembled as shown in FIGS. 1-2. The shoulders 44 are not required in some embodiments. The first and second inserts 20, 22 may have alternative arrangements and structure that permit, for example, flush mounting with an end surface of the first and second tent pole sections 12, 14, respectively.

In at least some examples, portions of the shoulder 44 or other features of the first and second inserts 20, 22 may configured to extend around and contact an outer surface of the first and second tent pole sections 12, 14 (although this embodiment is not shown in the drawings). Contact between an outer surface of the first and second tent pole sections 12, 14 and the first and second inserts 20, 22 may be used to help connect the first and second inserts 20, 22 to the first and second tent pole sections 12, 14, respectively.

The compression projections or connection arms 46 may comprise any connection feature that is used to provide connection between the first and second inserts 20, 22 and the projection member 24. In at least one example, the compression projections 46 are constructed as flexible, cantilevered structures positioned at the first end 40 of each of the first and second inserts 20, 22. The compression projections 46 place a compressive force on the projection member while enhancing the friction fit between the insert and the tent pole section when the projection member is inserted into one of the first and second inserts 20, 22. The compression projections 46 may include a rim or lip feature 52 (see FIGS. 5 and 6) that interfaces with a portion of the projection member 24 to provide a connection therebetween. The compression projections or connection projections 46 may be movable or flexible to provide a releasable connection between the first and second inserts 20, 22 and the projection member.

Figure 6:
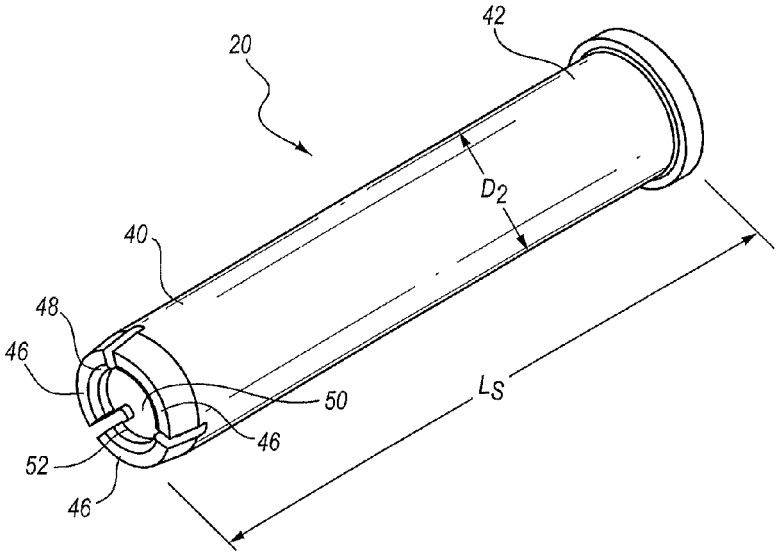
FIG. 6 is a perspective view of a projection member of the tent pole connection system of FIG. 4.

Each of the first and second inserts 20, 22 may include a plurality of compression projections 46. In at least one example, the first and second inserts 20, 22 include two or more compression projections 46. More specifically, three compression projections may be provided, as shown in FIG. 6. The lip 52 may extend radially inward from a portion of each compression projection 46. Alternatively, the first and second inserts 20, 22 may include other connection features that interface with the projection member 24 to provide a connection (whether a more permanent or releasable connection) with the projection member 24. The connection feature may be located at any position along the length of the first and second inserts 20, 22. Typically, the connection feature extends radially inward to contact the projection member 24 while the projection member 24 is positioned at least partially extending within the first and second inserts 20, 22.

In at least some arrangements, as shown for example in FIG. 6, the cavity 50 of the first and second inserts 20, 22 may be sized to provide an interference fit with the projection member 24. Alternatively, another type of mechanical connection between the first and second inserts 20, 22 and the projection member 24 (i.e., the connection projections 46 or other connection features).

Figure 7:
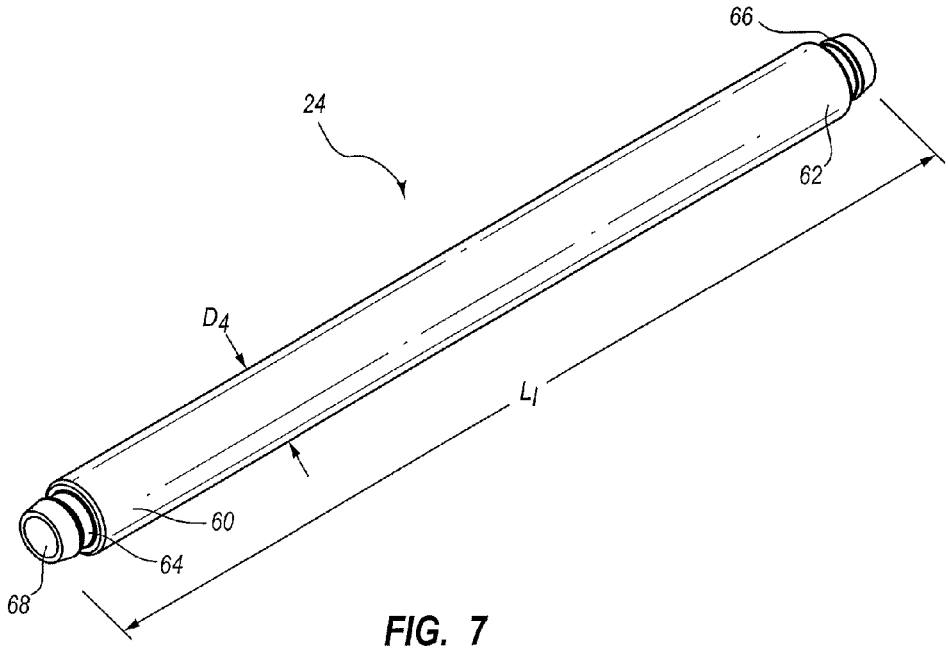
FIG. 7 is a perspective view of a coupling system member of the tent pole connection system of FIG. 4.

Referring to FIGS. 5 and 7, the projection member 24 includes first and second ends 60, 62 and first and second annular grooves or recesses 64, 66 defined in the first and second ends 60, 62, respectively. A cavity 68 is defined in the projection member 24 and extends from the first end 60 to the second end 62. The cavity 68 is typically sized to permit the connection member 26 to pass through from the first end 60 to the second end 62. In some arrangements, the projection member 24 has a solid structure without the cavity 68, and the tent pole connection system is operable without the use of the connection member 26.

The first and second grooves 64, 66 are sized to receive the lip feature 52 of the connection projections 46 of the first and second inserts 20, 22 (see FIG. 5). The first and second ends 60, 62 may have a tapered surface 69 extending from a tip minimum outer dimension $D_5$ (see FIG. 5). The dimension $D_5$ may be less than a maximum outer diameter $D_4$ of the projection member 24 at locations spaced from the first and second grooves 64, 66 (see FIG. 7). The tapered surface 69 and reduced tip diameter $D_5$ may promote easier positioning of the lip 52 into the first and second grooves 64, 66. A structure of the first and second grooves 64, 66 may help retain the position of the lip 52 within the first and second grooves 64, 66 until a threshold amount of force in a longitudinal axis direction is exceeded (i.e., the direction A shown in FIG. 5). In other arrangements, the first and second inserts 20, 22 and the projection member 24 do not include grove and lip features that provide a mechanical connection. Other connection features may be used such as, for example, a simple interference fit connection operable between the projection member 24 and at least one of the first and second inserts 20, 22.

The projection member 24 typically has a total length $L_I$ that is greater than the combined lengths $L_S$ of the first and second inserts 20, 22. Having a length $L_I$ for the projection member 24 that is greater than the combined lengths $L_S$ of the first and second inserts 20, 22 may be advantageous when the connection projections 46 and associated lip 52 are positioned at the first ends 40 of the first and second inserts 20, 22. Other arrangements are possible, such as those described above wherein the connection feature of the first and second inserts 20, 22 is positioned at a location spaced between the first and second ends 40, 42. In such an arrangement, the first and second grooves 64, 66 or other connection features on the projection member 24 may be positioned at a different location along the length $L_I$ of the projection member 24, which may result in the shortening of the total length $L_I$ of the projection member 24.

The projection member 24 may be described as a structure which extends, at least in part, into each of the first and second inserts 20, 22. The projection member may include at least one anchor feature along its length. The anchor feature may include at least a portion of the first and second grooves 64, 66, the tapered surface 69, or other features. The anchor feature may be positioned at one of the first or second ends 60, 62. The anchor feature may be at least partially positioned extending distally beyond a distal end of at least one of the first and second inserts 20, 22.

The connection member 26 of the linkage assembly 43 (see FIG. 4) includes first and second ends 70, 72, and enlarged end retention members 74 positioned at each of the first and second ends 70, 72. Retention members 74 function to retain the end abutment members 28, 30. The connection member 26 may have a length $L_C$ defined between the retention members 74 (see FIG. 3). The length $L_C$ is typically greater than the length $L_I$ of the projection member 24 and the combined lengths $L_S$ of each of the first and second inserts 20, 22. In some arrangements, the connection member 26 is directly connected to at least one of the first and second inserts 20, 22 or at least one of the end abutment members 28, 30. In one example, the connection member 26 does not pass through the first and second inserts 20, 22, but instead is connected to the inserts at a different location such as at the second end 42. The connection member 26 may be integrally formed as a single piece with at least one of the first and second inserts 20, 22.

The retention members 74 are sized to restrict movement of the end abutment members 28, 30 in an axial direction relative to the first and second inserts 20, 22 to help retain the first and second end abutment members 28, 30 on the connection member 26. The first and second end abutment members 28, 30 may include an outer dimension $D_6$ and an aperture 86 having an aperture dimension $D_7$. Typically, the retention members 74 have a greater maximum size than the minimum aperture dimension $D_7$. The retention members 74 may be formed as a crimp, knot, or any other structure having any construction that provide the function of limiting disconnection of the connection member 26 from the first and second end abutment members 28, 30. The outer dimension $D_6$ of the first and second end abutment members 28, 30 may be greater than the tip minimum diameter $D_5$. The outer diameter $D_6$ is typically greater than the inner diameter $D_3$ to prevent movement of the first and second end abutment members 28, 30 into the respective cavities 50 of the first and second inserts 20, 22. In some arrangements, the retention members 74 are sized large enough to eliminate the need for the first and second abutment members 28, 30. The retention members 74 and first and second end abutment members 28, 30 may be referred to generally as stop features used to help maintain assembly of the connection member 26 with the first and second inserts 20, 22.

In some arrangements, the retention members 74 are mounted to the connection member 26 after assembly of the tent pole connection system 16. FIG. 3 identifies components of a tent pole connection system 16 in a disassembled state. FIG. 4 shows the tent pole connection system 16 in an assembled state wherein the connection member 26 extends through the first and second inserts 20, 22, the projection member 24, and the first and second end abutment members 28, 30. As noted above, the first and second abutment member 28, 30 may not be required in some embodiments in order to maintain connection of the connection member 26 with the first and second inserts 20, 22. The first and second ends 70, 72 of the connection member 26 extend beyond the first ends 40 of the first and second inserts 20, 22 and beyond the first and second ends 60, 62 of the projection member 24 (see FIG. 7). The retention members 74 are positioned axially beyond the first and second end abutment members 28, 30. Typically, the connection member 26 has a length $L_c$ that is great enough to permit removal of the projection member 24 from each of the first and second inserts 20, 22. In some arrangements, the connection member length $L_C$ is great enough to permit removal of the projection member 24 from only one of the first and second inserts 20, 22 while the tent pole connection system 16 remains assembled together.

The connection member 26 may comprise a flexible or bendable material. In some embodiments connection member 26 may be relatively inelastic in a longitudinal direction. In other embodiments, the connection member 26 may comprise a material and construction that provide at least some elastic properties. The elastic properties may permit lateral as well as longitudinal flexibility. In one example, the connection member 26 may comprise a suitable shock cord or another type of elastic cord material, such as the cord used in the elastic cord fastening system described above. The connection member 26, regardless of its material construction, may have any desired length, cross-sectional size and shape, or configuration (e.g., straight, coiled, or pre-bent) along its length.

Figure 8:
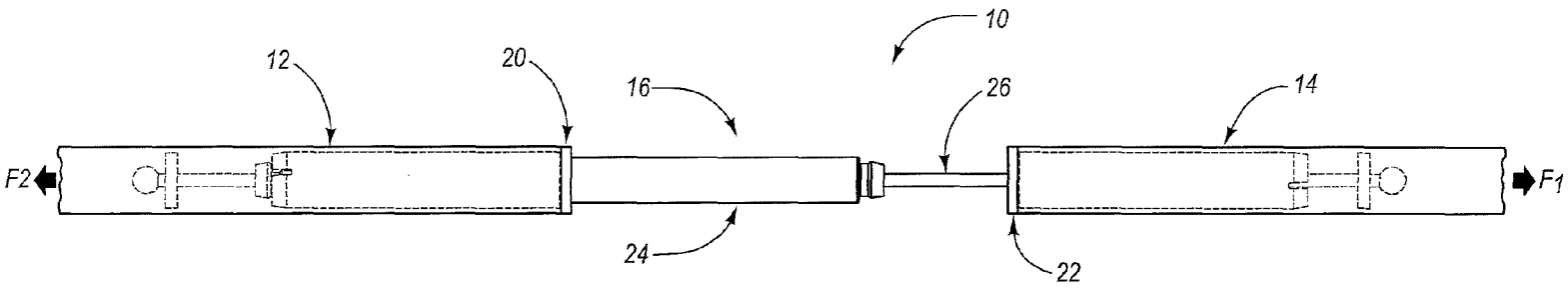
FIG. 8 is side view of the tent pole assembly of FIG. 1 in a partially disassembled arrangement.
Figure 9:
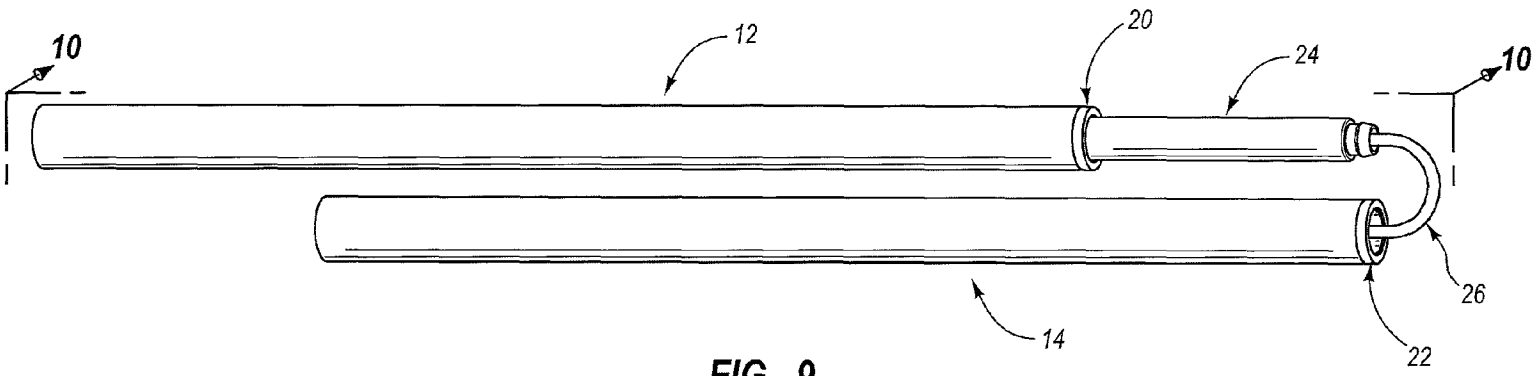
FIG. 9 is a side view of the tent pole assembly of FIG. 8 with the tent pole sections arranged side-by-side.
Figure 10:
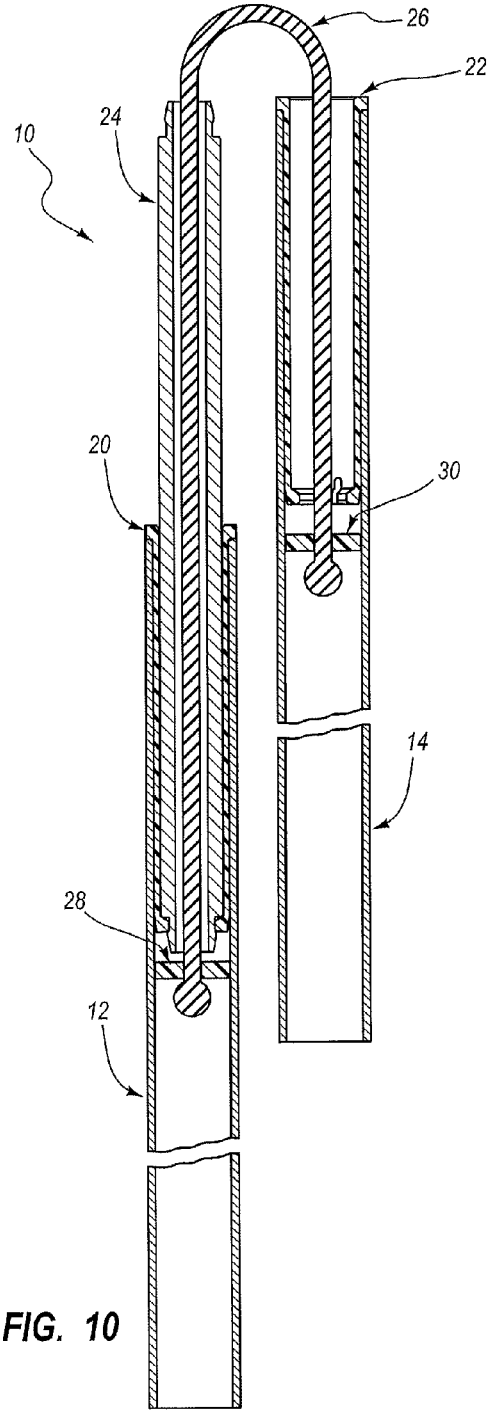
FIG. 10 is a cross-sectional view of the tent pole assembly of FIG. 9 taken along cross-sectional indicators 10-10.

FIG. 8 illustrates the tent pole connection system 16 mounted to the first and second tent pole sections 12, 14 with the projection member 24 removed from the second insert 22. Connection member 26 may be made of any suitable material, such as nylon, with at least some flexible characteristics. Thus, when projection member 24 is removed form the first insert 20 or the second insert 22, the connection member 26 bends to permit the first and second tent pole sections 12, 14 to be moved into a side-by-side orientation as shown in FIGS. 9 and 10. Mounting a tent pole connection system 16 at each end of a plurality of tent pole sections may provide a tent pole assembly wherein all of the poles may be arranged side-by-side in a compact orientation for stowage while remaining in an overall linked assembly, and, alternatively, be connected together in a coaxial arrangement to create a tent pole which may be used to support a tent.

In the tent pole assembly 10 shown and described with reference with FIGS. 1-11, the first and second tent pole sections 12, 14 may be arranged in a side-by-side orientation by removing the projection member 24 from at least one of the first and second inserts 20, 22. In some arrangements, only one of the first and second inserts 20, 22 may have a releasable connection with the projection member 24, while the other of the first and second inserts 20, 22 may have a permanent connection with the projection member 24.

When each of the first and second inserts 20, 22 is configured to provide a releasable connection with the projection member 24, the releasable connection that involves the least amount of force in the axial direction to disconnect the insert from the insert is typically the connection that releases first. The amount of force required to disconnect the projection member 24 from one of the first and second inserts 20, 22 may be altered by, for example, the size of the lip 52 from the compression projections 46, the depth or size of the first and second grooves 64, 66 of the projection member 24, relative sizes between the inner diameter $D_3$ of the first and second inserts 20, 22 and the outer diameter $D_4$ of the projection member 24, and the amount of friction between the insert and the projection member along their lengths.

The tent pole connection system shown in FIG. 4 may be considered an assembly of individual parts even if the projection member 24 is not inserted into or in contact with either one of the first and second inserts 20, 22. Generally, the first and second inserts 20, 22 and projection member 24 may be considered to be coupled together as an assembly even if the projection member 24 is not inserted or does not project into and/or in connection with at least one of the first and second inserts 20, 22 (e.g., as shown in FIG. 4).

The tent pole connection system 16 may be defined as a discrete assembly of parts that is used to connect two tent pole sections together. Typically, the size (e.g., length) of each of the individual parts of the tent pole connection system 16 is minimized to reduce the amount of weight for the tent pole connection system 16. Further, the materials used for the individual parts of the tent pole connection system 16 are selected so as to reduce the total weight of the tent pole connection system 16.

In at least one example, the first and second inserts 20, 22 and projection member 24 may comprise a synthetic or a composite material. In other examples, at least one of the first and second inserts 20, 22 and projection member 24 comprises aluminum or an aluminum alloy. Some individual pieces of the tent pole connection system 16 may comprise a combination of multiple materials or layers of materials. The materials used in the tent pole connection system 16 may provide different properties, such as strength, rigidity, wear resistance, corrosion resistance, or other advantageous properties typically desired for outdoor products. Some or all of the components of the tent pole connection system 16 may comprise polymeric materials (e.g., nylon or Kevlar), metal materials (e.g., aluminum or titanium), or fibrous materials (e.g., carbon fiber or fiberglass). In at least one example, the connection member 26 comprises a high-strength, polymeric material that provides some flexibility in bending and resist deformation in the axial direction. The first and second end abutment members 28, 30 may comprise, for example, a plastic material and may be constructed as a relatively flat, disc-shaped structure.

The retention members 74 of the connection member 26 may comprise a concentrated mass of the same material used for the connection member 26. The retention members 74 may be integrally formed with the connection member 26. Alternatively, the retention members 74 may be separately constructed and connected to the connection member 26 in a separate assembly step. For example, at least one of the retention members 74 may be provided on the connection member 26 after assembling the first and second inserts 20, 22, projection member 24, and first and second end abutment members 28, 30 onto the connection member 26.

Assembly of the tent pole connection system 16 may follow a particular order. In one example, the connection member 26 is provided with a retention member 74 at one end, followed by mounting the first abutment member 28 onto the connection member 26, followed by mounting the first insert 20 onto the connection member 26, followed by mounting the projection member 24 onto the connection member 26, followed by mounting the second insert 22 onto the connection member 26, followed by mounting the second abutment member 30 onto the connection member 26, followed by mounting a second retention member 74 at an opposite end of the connection member 26. In another example, the projection member 24 is first mounted onto the connection member 26, followed by mounting the first and second inserts 20, 22 onto the connection member 26, followed by mounting the first and second abutment members 28, 30 onto the connection member 26, followed by mounting the retention members 74 onto each of the first and second ends 70, 72 of the connection member 26.

Many other methods of assembling the tent pole connection system 16 are possible. In at least one example, at least one of the retention members 74 may be releasably mounted to the connection member 26. Such releasable mounting of a retention member 74 may provide for removal of one of the components 20, 22, 24, 26, 28, 30 from the rest of the tent pole connection system 16 for maintenance, replacement, or disassembly of the first and second tent pole sections 12, 14 when connected together by the tent pole connection system 16 (i.e., if a threshold axial force is exceeded in attempting to disconnect the first and second tent pole sections 12, 14 from each other). In at least some arrangements, the retention members 74 may be permanently mounted to the connection member 26. In at least one example, (i.e., see FIG. 11) a retention member 74 may assist in removing the first and second inserts 20, 22 from the first and second tent pole sections 12, 14.

Figure 11:
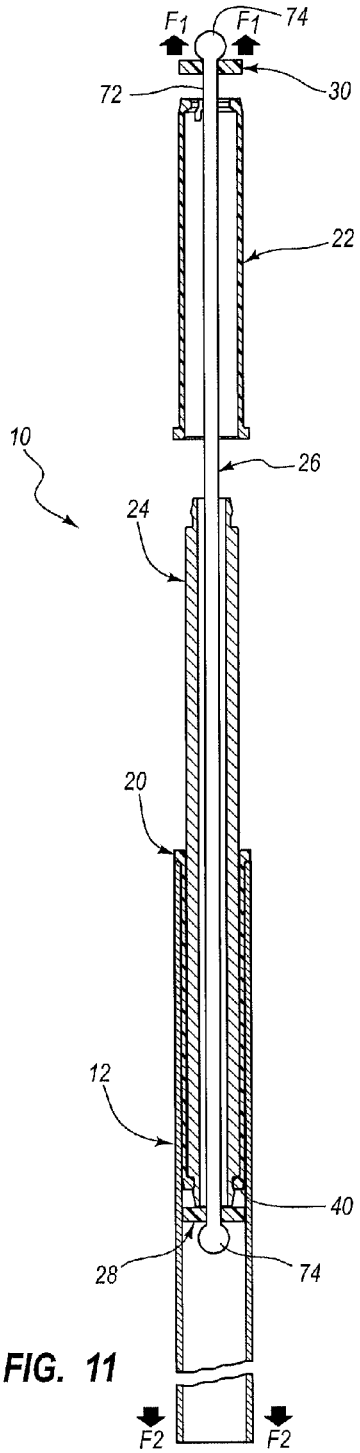
FIG. 11 is a cross-sectional view of a portion of the tent pole assembly of FIG. 1.

FIG. 11 illustrates application of a force $F_1$ at the second end 72 of the connection member 26 (e.g., by pulling on the second insert 22 or second abutment member 30) and application of an opposite force $F_2$ to the first tent pole section 12. Forces $F_1$, $F_2$ result in application of a force at first end 40 of the first insert 20 that helps remove the first insert 20 from the first tent pole section 12. A similar disassembly may occur between the second insert 22 and the second tent pole section 14 by applying forces $F_1$, $F_2$ to the first and second tent pole sections 12, 14, respectively, when in the arrangement shown in FIG. 8, or by applying the force $F_2$ to the projection member 24 in the arrangement shown in FIG. 28 while applying the force $F_1$ to the second tent pole section 14.

Disassembly of the tent pole connection system 16 from the first and second tent pole sections 12, 14 may permit repair and maintenance of portions of the tent pole connection system 16, or replacement or repair of one of the first and second tent pole sections 12, 14. Such repair, maintenance or replacement of these individual parts may be done without having to disassemble all of the plurality of tent pole sections that are arranged coaxially into a complete tent pole that may be used to support a tent. Such repair, maintenance or replacement of parts may be possible in the field by the tent user without having to return the tent pole assembly to the retail source or manufacturer of the tent pole assembly.

Referring to FIGS. 1-4 and 8-11, a method of using a tent pole assembly is now described. The tent pole assembly 10 may be assembled in a series of steps that may begin with providing a tent pole connection system. A tent pole connection system may be arranged as a plurality of individual parts that are disassembled, such as shown in FIG. 3, or may be provided as an assembly that is connected together, such as shown in FIGS. 2 and 4. If the tent pole connection system 16 is provided as a disassembled plurality of parts as shown in FIG. 3, the parts may be assembled together as described in the examples above until arranged as shown in FIG. 2 or FIG. 4. In a further step, one of the first or second inserts 20, 22 is inserted into one of the first and second tent pole sections 12, 14 (e.g., see FIG. 11). In a further step, the other of the first or second inserts 20, 22 is inserted into the other of the first or second tent pole sections 12, 14 (i.e., see FIG. 8). The projection member 24 may be placed into one of the first or second inserts 20, 22 at any time after inserting the first or second inserts 20, 22, as appropriate, into the first or second tent pole sections 12, 14. The projection member 24 is then placed into the other of the first and second inserts 20, 22 to provide a connection between the first and second tent pole sections 12, 14 so that the first and second tent pole sections 12, 14 are arranged coaxially as shown in FIG. 1. When the assembly is complete as shown in FIG. 1, the tent pole assembly 10 may be used as a support structure with, for example, a tent.

Disassembly of the tent pole assembly 10 from the arrangement shown in FIG. 1 includes removing the projection member 24 from one of the first and second inserts 20, 22 such as shown in FIG. 8. The first and second tent pole sections 12, 14 may then be moved relative to each other such as into the side-by-side orientation shown in FIGS. 9 and 10. In some arrangements, the projection member 24 may be removed from both of the first and second inserts 20, 22 to provide further relative movement between the first and second tent pole sections 12, 14.

Figure 12:
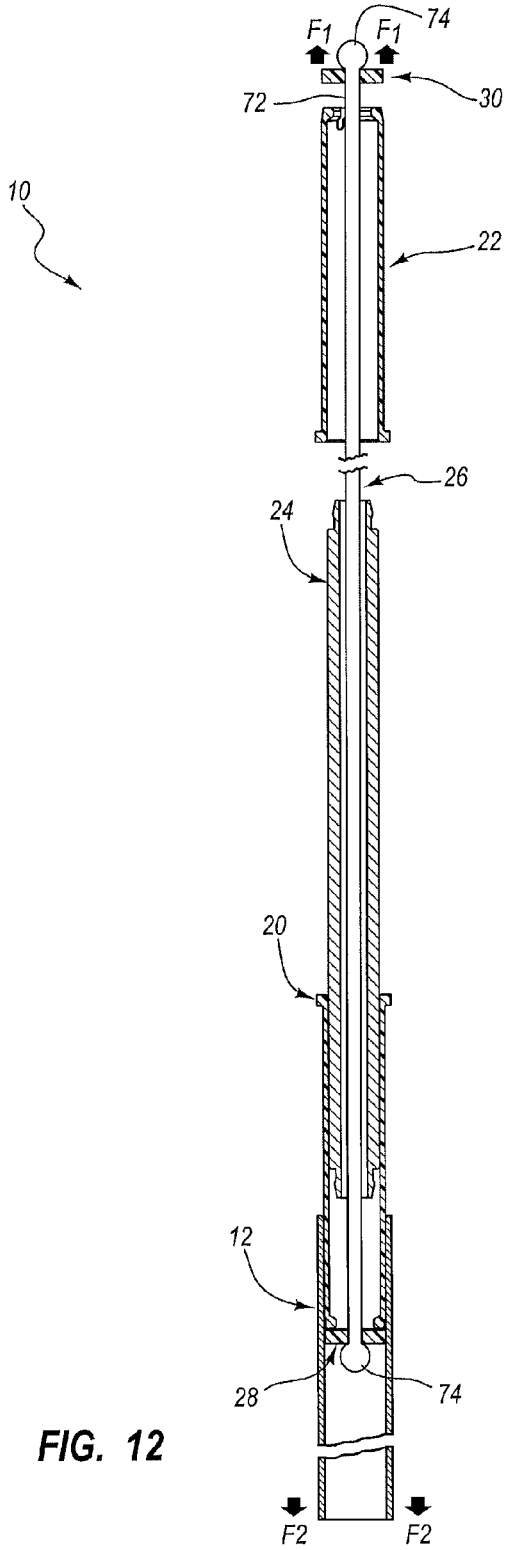
FIG. 12 is another cross-sectional view of the portion of the tent pole assembly of FIG. 11.
Figure 13:
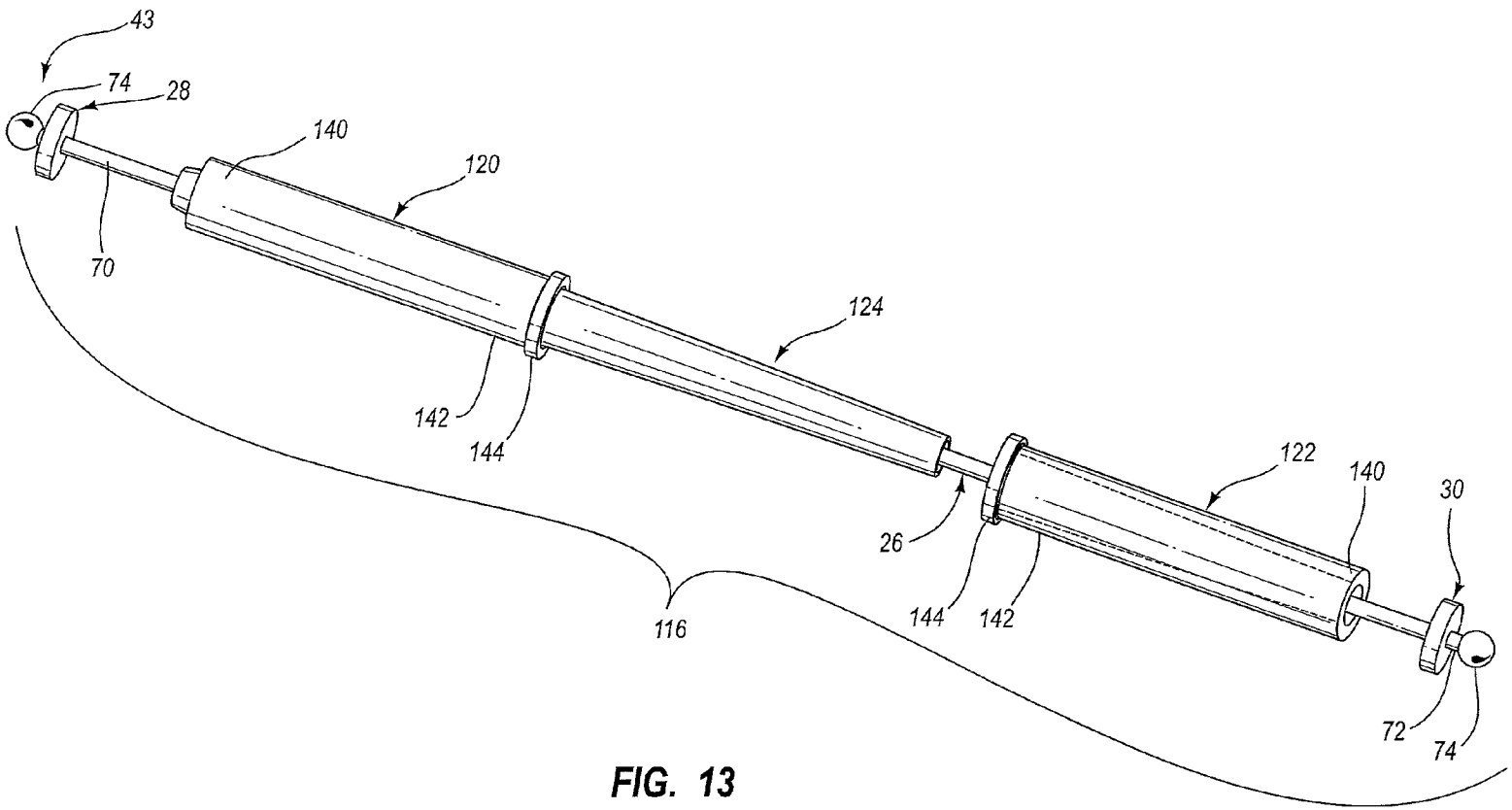
FIG. 13 is a perspective view of a tent pole connection system for a tent pole assembly according to an additional embodiment.
Figure 14:
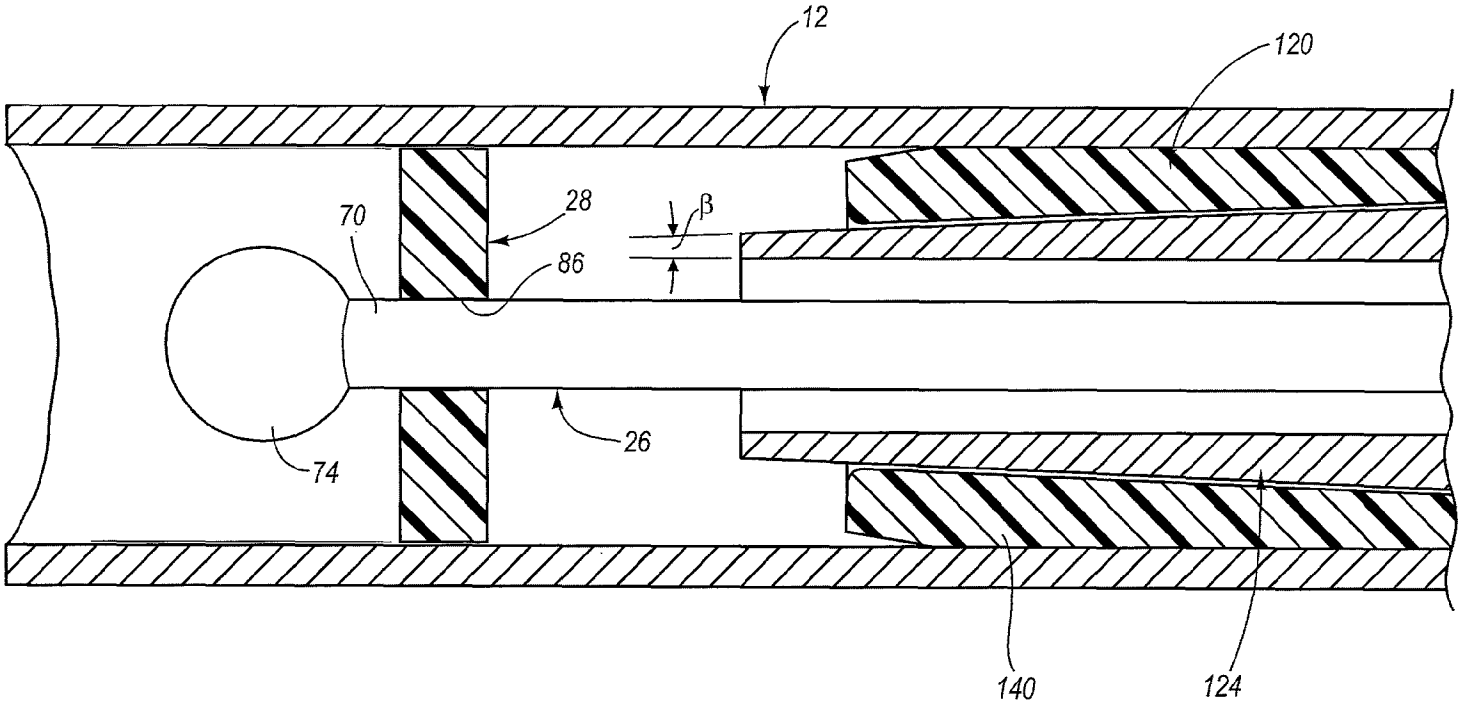
FIG. 14 is a cross-sectional view of a portion of the tent pole connection system of FIG. 13.
Figure 15:
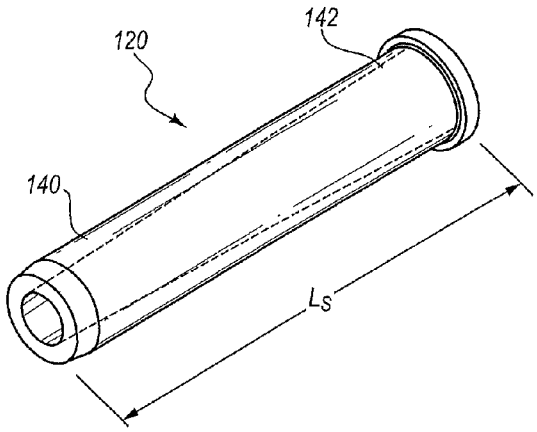
FIG. 15 is a perspective view of an insert of the tent pole connection system of FIG. 13.
Figure 16:
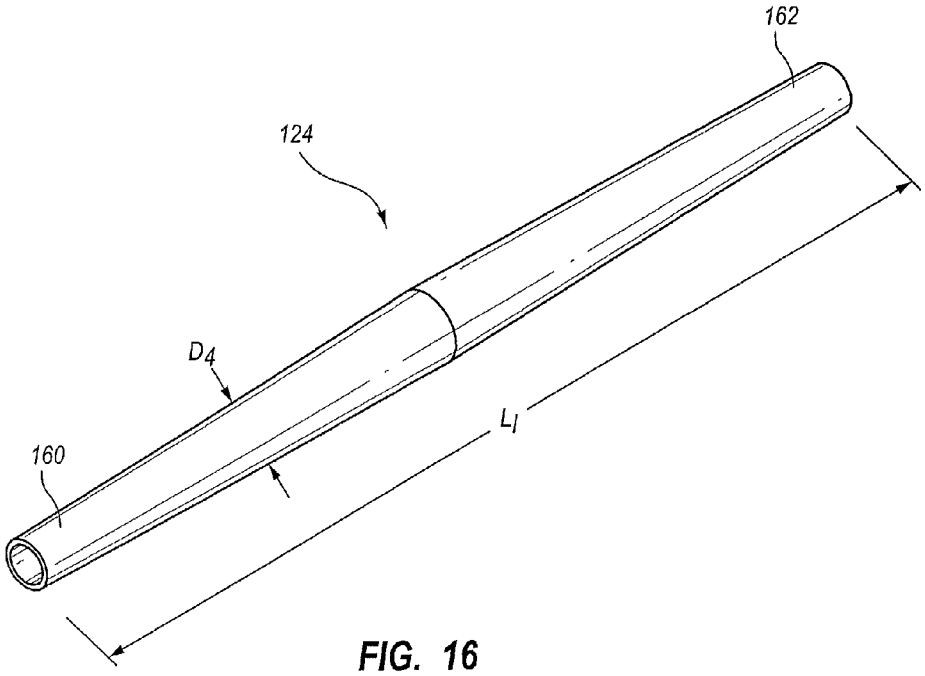
FIG. 16 is a perspective view of a projection member of the tent pole connection system of FIG. 13.
Figure 17:
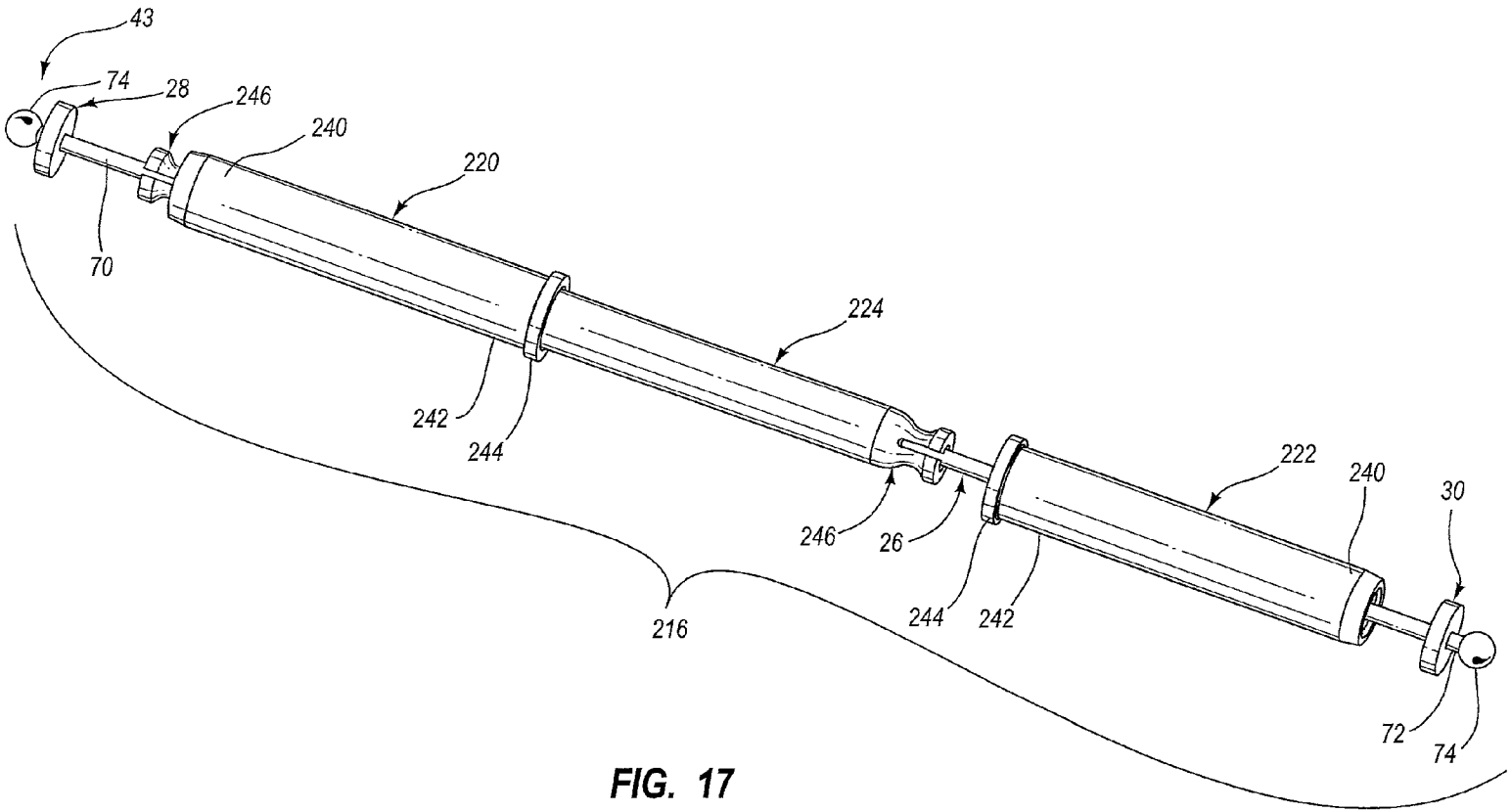
FIG. 17 is a perspective view of a tent pole connection system for a tent pole assembly according to an additional embodiment.

The tent pole connection system 16 may be removed from at least one of the first and second tent pole sections 12, 14 by applying an axial force in the directions $F_1$ and $F_2$ to the first and second tent pole sections 12, 14 as shown in FIG. 8. Application of the forces $F_1$, $F_2$ will typically move the first and second abutment members 28, 30 into contact with the retention members 74, disconnect the projection member 24 from its releasable connection with at least one of the first and second inserts 20, 22, and into contact with the first ends 40 of at least one of the first or second inserts 20, 22. Further application of the forces $F_1$, $F_2$ will tend to remove one of the first or second inserts 20, 22 from one of the first or second tent pole sections 12, 14 (i.e., see FIG. 11). Further application of the forces $F_1$, $F_2$ as shown in FIG. 12 may be applied to remove the other of the first or second inserts 20, 22 from the other of the first or second tent pole sections 12, 14.

Once the first and second inserts 20, 22 are at least partially removed from the first and second tent pole sections 12, 14 by applying a force directly or indirectly on the connection member 26 or first and second abutment members 28, 30, the user may grasp one of the first and second inserts 20, 22 directly and apply an axial force needed to remove the other of the first and second inserts 20, 22 completely from the first and second tent pole sections 12, 14.

Alternative arrangements are possible for the tent pole assembly and tent pole connection system described herein. In one example, the first and second abutment members 28, 30 may be eliminated and/or replaced by retention members 74 on the connection member 26 that have a greater size and provide a similar stop function. In one example, the retention members 74 may be sized to limit passage of the retention members through the cavity 50 of the first and second inserts 20, 22 and through the cavity 68 of the projection member 24.

In other examples, at least one of the first and second inserts 20, 22 may be eliminated from the tent pole connection system. The projection member may be constructed to provide a releasable connection with a portion of the first and second tent pole sections and the connection member may be retained within the first and second tent pole sections using, for example, a connection directly to a portion of the first and second tent pole sections or a connection of the first and second abutment plates to portions of the tent pole.

Referring now to FIGS. 13-16, another tent pole connection system 116 is shown and described. The tent pole connection system 116 may include first and second inserts 120, 122, a projection member 124, a connection member 26, and first and second abutment members 28, 30. The features and functionality of the tent pole connection system 116 may be similar to the other tent pole connection systems described herein, in particular the tent pole connection system 16.

A difference between the tent pole connection systems 16, 116 relates to a interference connection interface between the first and second inserts 120, 122 and projection member 124. In one example, at least one of the first and second inserts 120, 122 is configured to connect to the projection member 124 with an interference fit. Typically, the interior cavity 50 of the first and second inserts 120, 122 may be sized and constructed to mirror substantially a size and shape of an outer surface of a portion of the projection member 124. In one example, the first and second inserts 120, 122 may include a tapered surface extending from the second end 142 toward the first end 140, and the projection member 124 includes a matching tapered surface extending from a center portion towards the first and second ends 160, 162. In at least some constructions, mating tapered surfaces may provide both a connection between the projection member 124 and the first and second inserts 120, 122, and provide easier disconnection when a disconnection is intended. The taper of the tapered surface may be formed at an angle β in the range of about 1 degree about 30 degrees. In some arrangements, a draft angle designed in to the first and second inserts 120, 122 and projection member 124 for easy ejection from a mold provides sufficient taper.

Referring now to FIGS. 17-20, another tent pole connection system 216 is shown and described. The tent pole connection system 216 may include first and second inserts 220, 222, a projection member 224, a connection member 26, and first and second abutment members 28, 30. The features and functionality of the tent pole connection system 216 may be similar to the other tent pole connection systems described herein.

Figure 18:
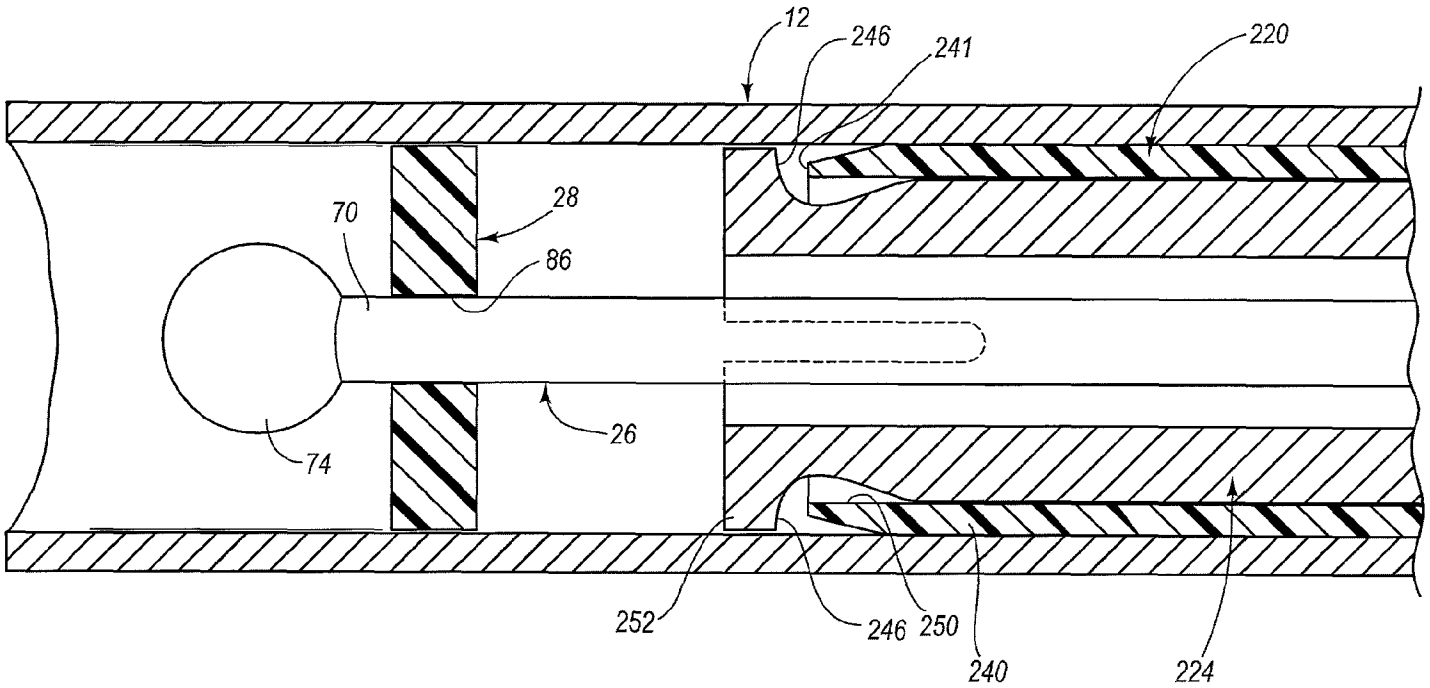
FIG. 18 is a cross-sectional view of a portion of the tent pole connection system of FIG. 17.
Figure 19:
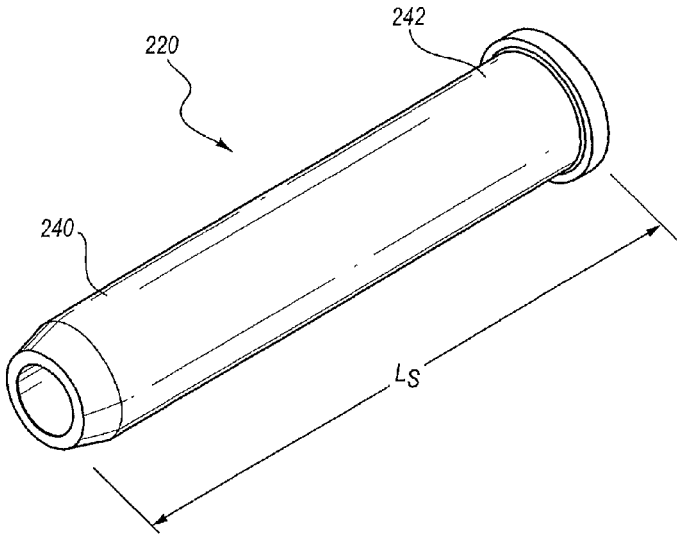
FIG. 19 is a perspective view of an insert of the tent pole connection system of FIG. 17.
Figure 20:
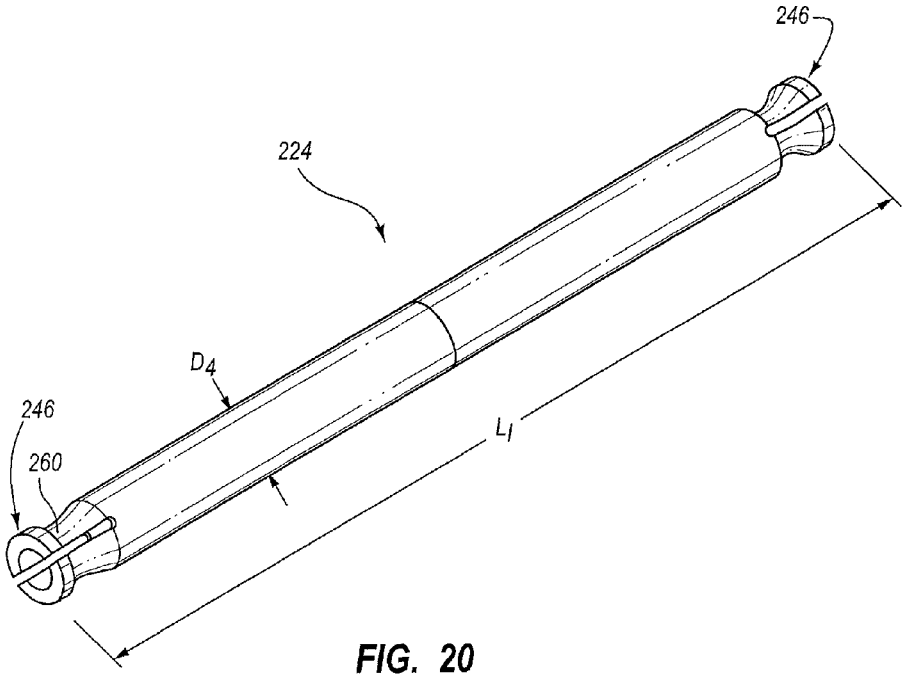
FIG. 20 is a perspective view of a projection member of the tent pole connection system of FIG. 17
Figure 21:
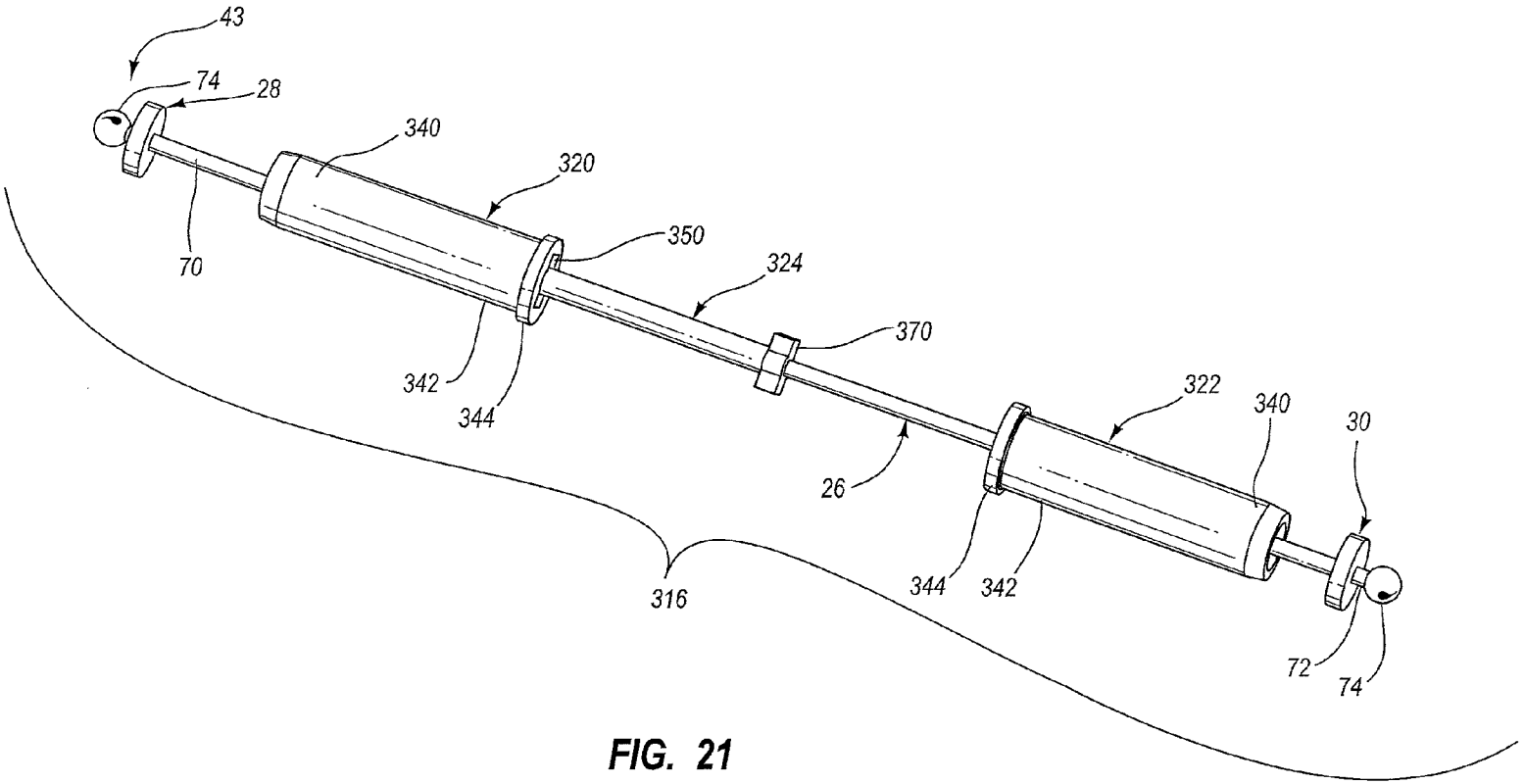
FIG. 21 is a perspective view of a tent pole connection system for a tent pole assembly according to an additional embodiment.
Figure 22:
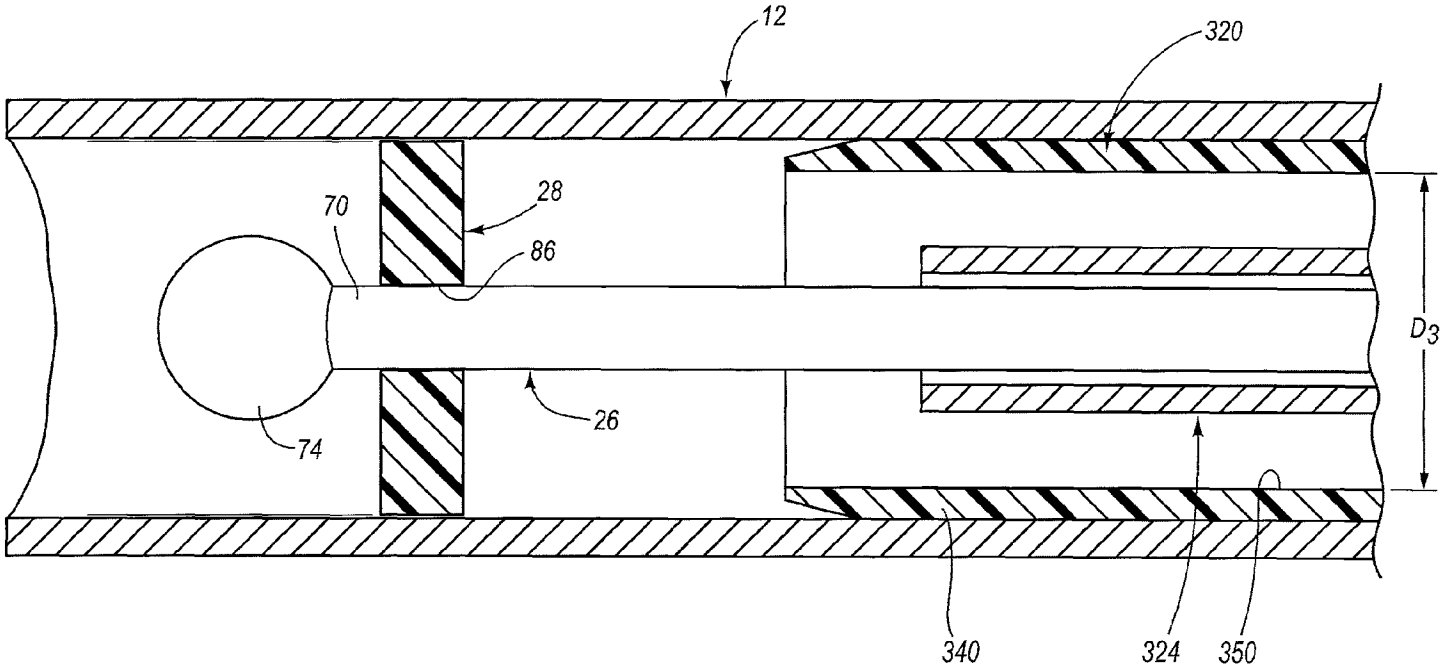
FIG. 22 is a cross-sectional view of a portion of the tent pole connection system of FIG. 21.
Figure 23:
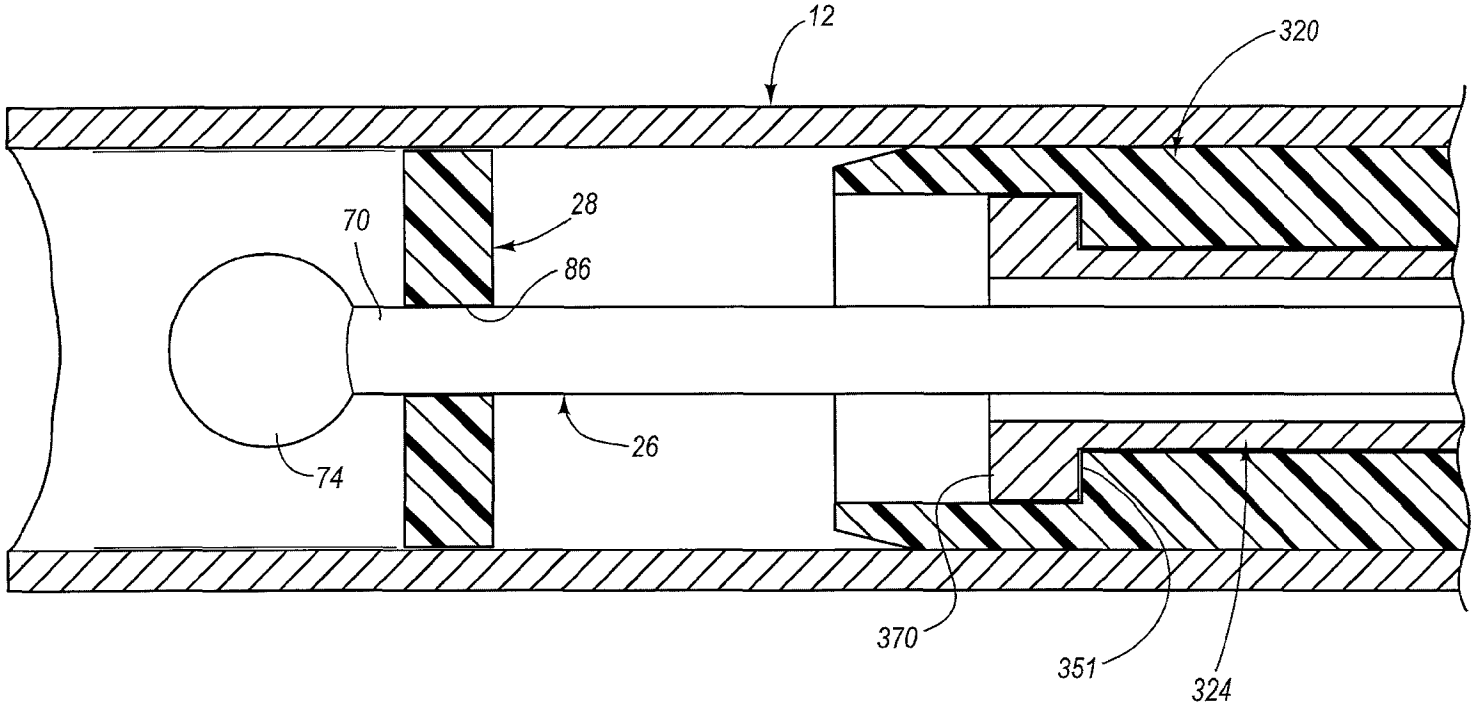
FIG. 23 is a cross-sectional view of a portion of the tent pole connection system of FIG. 21.
Figure 24:
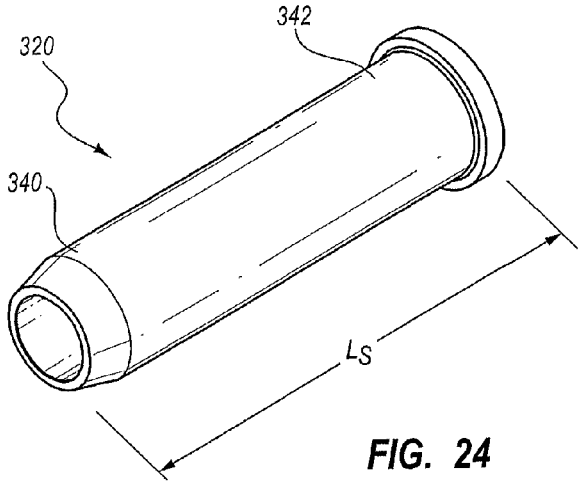
FIG. 24 is a perspective view of an insert of the tent pole connection system of FIG. 21.
Figure 25:
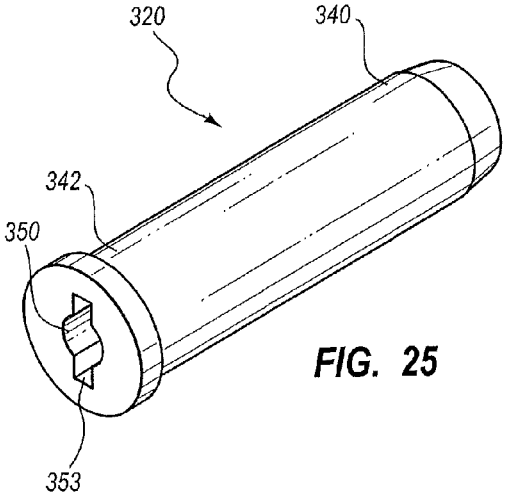
FIG. 25 is a perspective view of an insert of the tent pole connection system of FIG. 21.
Figure 26:
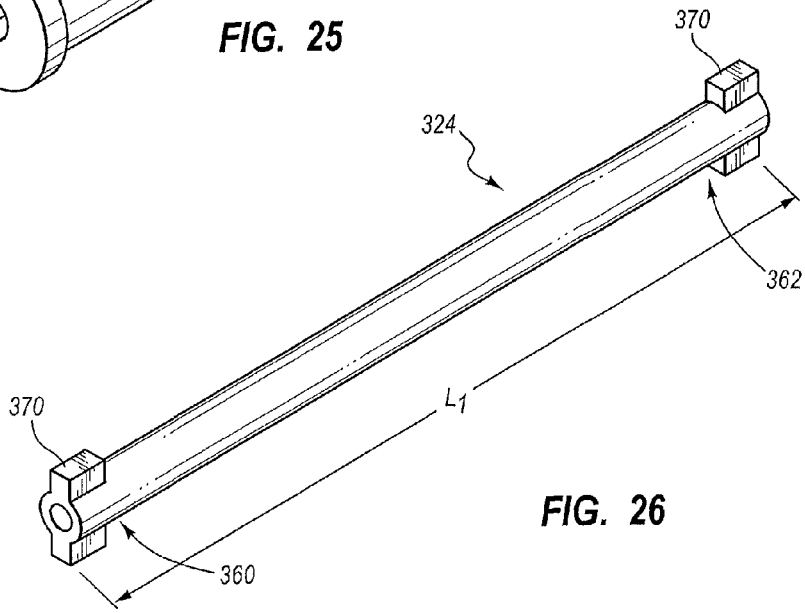
FIG. 26 is a perspective view of a projection member of the tent pole connection system of FIG. 21.

The connection features of the tent pole connection system 216 are somewhat reversed as compared to the tent pole connection system 16. In one example, the projection member 224 includes at least one flexible compression projection member 246 that provides a releasable connection with a groove, projection or contact surface of the first and second inserts 220, 222. FIG. 18 shows a lip 252 of the compression projections 246 contacting an end surface 241 of the first insert 220. The compression projections 246 may be constructed to flex inward toward the connection member 26 to position the lip 252 distal of the end surface 241. Moving the compression projections 246 into the position shown in FIG. 18 may provide a snap-fit connection and may be identified by an audible or tactile click that occurs upon assembly.

The connection features provided by the first and second inserts 220, 222 that mate with the compression projections 246 may be positioned at any location along the length of the first and second inserts 220, 222. For example, a projection may extend radially inward into the cavity 250 of the first and second inserts 220, 222 at a location spaced between the first and second ends 240, 242. The projection may interface with the compression projections 246 to provide a connection between the first and second inserts 220, 222 and the projection member 224. In at least some arrangements, the connection between at least one of the first and second inserts 220, 222 and the projection member 224 may be permanent.

The compression projections 246 may be constructed as flexible arms, the flexibility of which may be enhanced by circumferential groove 260, that move radially inward and outward upon application of a force applied in a radial direction. The force applied in a radial direction may be implemented by applying a longitudinal force to the projection member 224 when inserting or removing the projection member 224 relative to the first and second inserts 220, 222. The compression projections 246 may have any suitable shape or size. The compression projections 246 typically include at least two compression projections.

Referring now to FIGS. 21-26, another example tent pole connection system 316 is shown and described. The tent pole connection system 316 may include first and second inserts 320, 322, a projection member 324, a connection member 26, and first and second abutment members 28, 30. The features and functionality of the tent pole connection system 316 may be similar to the other tent pole connection systems described here.

The connection features of the tent pole connection system 316 may be generally referred to as a key hole locking arrangement. In one example, the projection member 324 includes a key portion 370 at opposing first and second ends 360, 362 (see FIG. 26). The key portion 370 is insertable through a key shaped cavity 350 (see FIG. 25) of the first and second inserts 320, 322. The cavity 350 may have at least one key receiver portion 353 through which the key portion 370 extends when moving the projection member 324 into and out of the cavity 350. The key-shaped cavity 350 includes an inner stop surface 351 (see FIG. 23) at a location along a length of the first and second inserts 320, 322 (see FIG. 23) that is contacted by the key portion 370 (upon rotation after insertion, as discussed below) of the projection member 324. The inner stop surface 351 may extend only partially around an internal surface of the cavity 350 so that the key portion 370 may extend distally past the inner stop surface 351 and be rotated into a position contacting the inner stop surface 351.

The tent pole connection system 316 may provide a twist-lock connection system to releasably connect the projection member 324 to at least one of the first and second inserts 320, 322. The tent pole connection system 316 may also be defined as a key lock connection system or a keyed connection system. The projection member 324 may have any combination of recesses and projections (e.g., key portion 370) that provide a key-like function when used with the first and second inserts 320, 322. In some arrangements, the first and second inserts 320, 322 and projection member 324 may include features that provide a releasable lock therebetween without a relative twisting action, as will be understood by those skilled in the art based upon the present disclosure.

Figure 27:
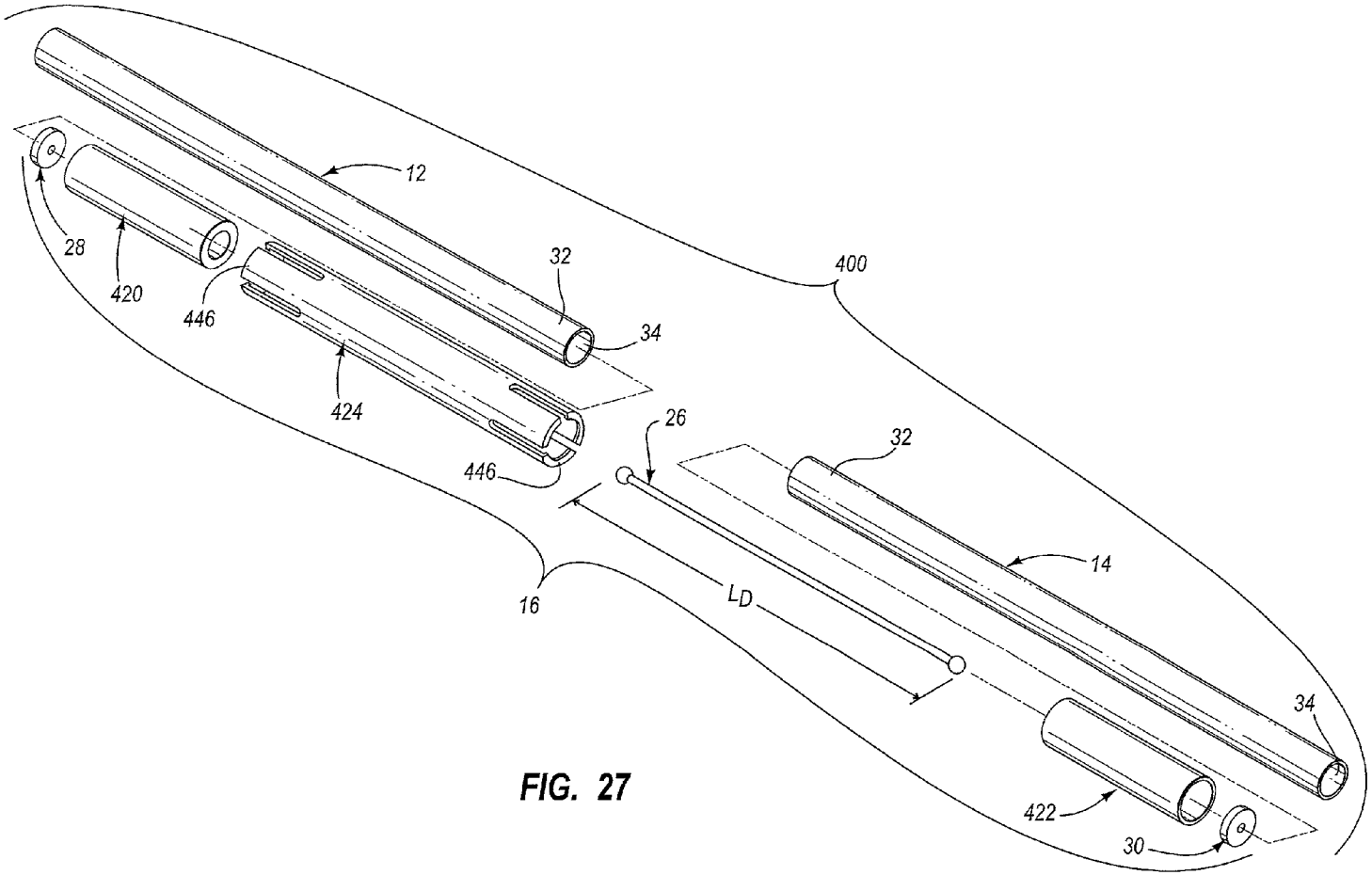
FIG. 27 is an exploded perspective view of a tent pole assembly including a tent pole connection system according to an additional embodiment.
Figure 28:
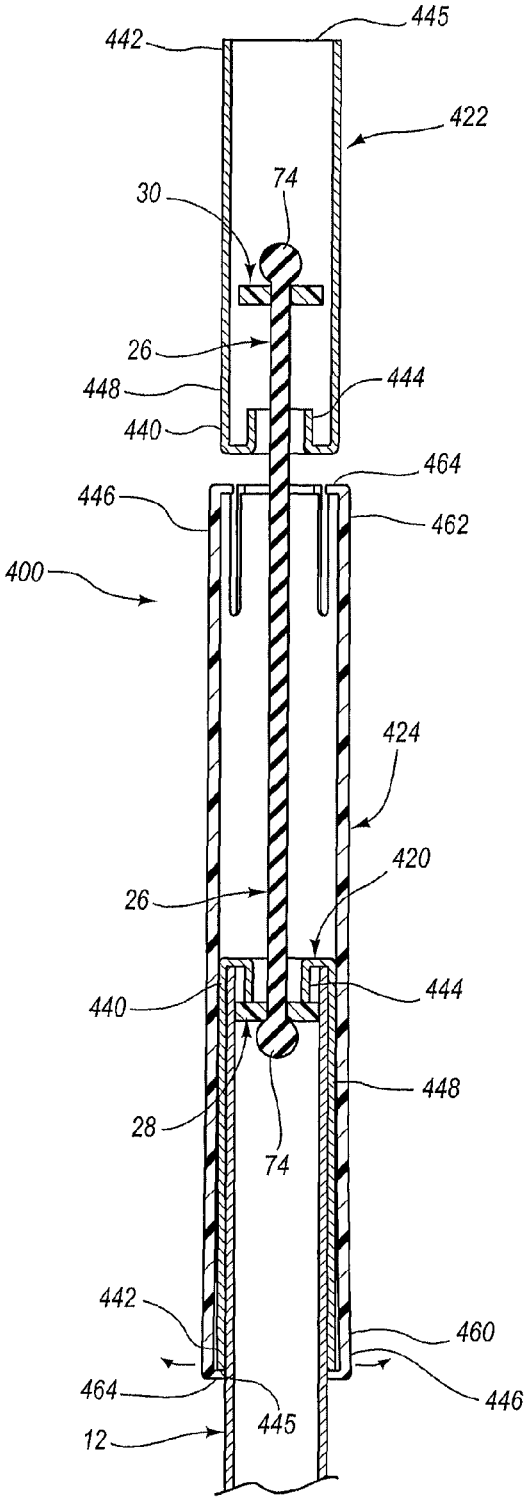
FIG. 28 is a cross-sectional view of a portion of the tent pole assembly of FIG. 27.

Referring now to FIGS. 27-28, another example tent pole connection system 416 is shown and described. The tent pole connection system 416 may include first and second inserts 420, 422, a projection member 424, a connection member 26, and first and second abutment members 28, 30. The features and functionality of the tent pole connection system 416 may be similar in some respects to the other tent pole connection systems described here.

The tent pole connection system 416 may be generally defined or referenced as a outer or over connection system rather than an inner connection system, such as those described with reference to FIGS. 1-26. Portions of the tent pole connection system 416 are positioned outside of the first and second tent pole sections 12, 14. In at least one arrangement, the connection interface between the first and second inserts 420, 422 and the projection member 424 is positioned outside of the first and second tent pole sections 12, 14.

The first and second inserts 420, 422 may each include first and second ends 440, 442, an insert portion 444, and an outsert portion 448. The insert portion 444 may be inserted into a respective one of the first and second tent pole sections 12, 14. The insert portion 444 may be connected to the first and second tent pole sections 12, 14 with, for example, an interference fit. The outsert portion 448 may extend continuously from the insert portion 444 across an end surface and along a side surface of the first and second tent pole sections 12, 14. An end surface 445 of the outsert portion 448 may define a stop surface against which the projection member 424 contacts to provide a connection between the first and second inserts 220, 222 and the projection member 424. The stop surface of the outsert portion 448 may be positioned at any location along a length of the outsert portion 448 and have any construction (e.g., a groove, lip, aperture, etc.).

The projection member 424 may include first and second ends 460, 462 and a connection lip 464 at each of the first and second ends 460, 462. In some arrangements, the projection member 424 may include at least one flexible member 446, similar to the flexible compression projections 46, 246 described above, positioned at each of the first and second ends 460, 462 to provide a releasable connection between the projection member 424 and the first and second inserts 420, 422. The projection member 424 may extend completely over and cover the first and second inserts 420, 422 when the first and second tent pole sections 12, 14 are connected together with the tent pole connection system 416. In other arrangements, the projection member 424 is positioned radially outward from at least a portion of the first and second inserts 420, 422, such as a portion of the first and second inserts 420, 422 that is positioned outside of the first and second tent pole sections 12, 14.

A connection between the first and second inserts 420, 422 and the projection member 424 may provide a snap-fit connection that provides an audible or tactile click when connecting and disconnecting. The tent pole connection system 416 may provide a releasable connection between the first and second tent pole sections 12, 14, and may provide a releasable connection between various features of the tent pole connection system 416.

In any of the alternative embodiments described herein with reference to FIGS. 13-28, at least some features of the tent pole connection systems may be permanently or releasably connected together. In at least some examples, an adhesive or other bond is provided between at least some features of the tent pole connection system to provide a permanent connection. Some of the embodiments shown in FIGS. 13-38 may be operable with the use of at least one of the connection member 26, first and second end abutment members 28, 30, or the retention members 74. Some tent pole connection systems may be operable with only the first and second inserts and projection member. In some arrangements, the connection member 26 is directly connected to at least one of the first and second insert members. Any of the projection members and first and second inserts may be solid or at least partially hollow. Many different types of structures and arrangements are possible for connecting together as an assembly the individual parts of the tent pole connection systems of FIGS. 13-16.

The tent pole connection systems 16, 116, 216, 316, 416 described herein may be maintained entirely within a compact longitudinal connection location. The compact longitudinal connection location may be defined at least in part by a portion of the tent pole, such as by a portion of each of the first and second tent pole sections 12, 14. FIG. 2 illustrates a compact longitudinal connection location X that overlaps portions of the first and second tent pole sections 12, 14 when the first and second tent pole sections are connected together with one of the tent pole connection systems 16, 116, 216, 316, 416.

The compact longitudinal connection location X may be any desired length. Typically, the compact longitudinal connection location X is less than an entire length of the tent pole (which tent pole is made up by a plurality of tent pole sections). In some arrangements, the compact longitudinal connection location X is less than either one of the lengths $L_{P1}$ and $L_{P2}$. In one embodiment, the compact longitudinal connection location X has a length that is less than about 24 inches and may be in the range of about 1 inches to about 12 inches. In another embodiment, the compact longitudinal connection location X has a length in the range of about 4 inches to about 8 inches.

The first and second tent pole sections 12, 14 may each have an outer profile. The outer profile may be defined by an outer diameter or maximum outer dimension of a cross-section of the first and second tent pole sections 12, 14. Typically, the outer profile of the first and second tent pole sections 12, 14 is the same for a given tent pole. In at least some tent pole assemblies, the tent pole connection system (e.g., the tent pole connection systems 16, 116, 216, 316 described herein) may be maintained entirely within the outer profile of the first and second tent pole sections 12, 14. In some arrangements (e.g., tent pole connection system 416), a portion of the tent pole connection system may be maintained within the outer profile of the first and second tent pole sections 12, 14, and other portions of the tent pole connection system may be positioned outside of the first and second tent pole sections 12, 14.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A tent pole assembly, comprising:

first and second pole sections, each pole section defining an open end;

first and second inserts insertable into the open ends of the first and second pole sections, respectively; and a projection member insertable into the first and second inserts to releasably connect the first and second pole sections together, the projection member being connected to at least one of the first and second inserts with a releasable snap-fit connection, the projection member being removable from at least one of the first and second inserts via an axial force;

an inelastic connection member extending completely through and coupling together the first insert, the second insert, and the projection member.

2. The assembly of claim 1, wherein at least a portion of the first and second inserts is configured to be positioned outside of the first and second pole sections, respectively.

3. The assembly of claim 1, wherein at least one of the first and second inserts includes a first connection feature that mates with a second connection feature of the projection member to create the releasable snap-fit connection.

4. The assembly of claim 3, wherein the first connection feature includes a resilient arm member, and the second connection feature is a groove, the resilient arm member being movable into and out of the groove.

5. The assembly of claim 1, wherein the first and second inserts are constructed to provide an interference fit within the first and second pole sections, respectively.

6. The assembly of claim 1, wherein at least one of the first and second inserts is bonded to the first and second pole sections, respectively.

7. The assembly of claim 1, further comprising first and second end abutment plates positioned at opposing first and second end portions of the connection member, the first and second end abutment plates being arranged and configured to couple the first and second inserts to the connection member.

8. The assembly of claim 1, wherein the first and second inserts each include a first connection feature, and the projection member includes a second connection feature positioned at opposing ends of the projection member, the first and second connection features mating to provide the releasable snap-fit connection between the first and second inserts and the projection member.

9. The assembly of claim 8, wherein the first connection feature includes a resilient arm, and the second connection feature includes a groove that receives a portion of the resilient arm.

10. The assembly of claim 1, wherein at least one of the first insert, second insert, and projection member include a layer of composite material.

11. A tent pole assembly, comprising:

first and second tent pole sections;

a tent pole union comprising:

a first insert and a second insert, each being completely separable from the first tent pole section and the second tent pole section during operation of the tent pole assembly; and a projection member configured to be insertable into the first and second inserts to connect the first and second tent pole sections to each other, the projection member being removable from the first and second inserts via an axial force;

a fixed length connection member extending completely through and coupling together the first and second inserts and the projection member.

12. The tent pole assembly of claim 11, wherein the first and second inserts are configured to be insertable into the first and second tent pole sections, respectively, with an interference fit to connect the first and second tent pole sections to each other.

13. The tent pole assembly of claim 11, wherein the fixed length connection member is movable axially relative to the first and second inserts.

* * * * *